US010989447B2

(12) United States Patent
Miura et al.

(10) Patent No.: US 10,989,447 B2
(45) Date of Patent: Apr. 27, 2021

(54) REFRIGERATION CYCLE DEVICE

(71) Applicant: DENSO CORPORATION, Kariya (JP)

(72) Inventors: Koji Miura, Kariya (JP); Yoshiki Kato, Kariya (JP); Masayuki Takeuchi, Kariya (JP); Nobuyuki Hashimura, Kariya (JP); Keigo Sato, Kariya (JP); Norihiko Enomoto, Kariya (JP); Kengo Sugimura, Kariya (JP); Ariel Marasigan, Kariya (JP)

(73) Assignee: DENSO CORPORATION, Kariya (JP)

( * ) Notice: Subject to any disclaimer, the term of this patent is extended or adjusted under 35 U.S.C. 154(b) by 111 days.

(21) Appl. No.: 16/256,202

(22) Filed: Jan. 24, 2019

(65) Prior Publication Data

US 2019/0154311 A1 May 23, 2019

Related U.S. Application Data

(63) Continuation of application No. PCT/JP2017/025870, filed on Jul. 18, 2017.

(30) Foreign Application Priority Data

Jul. 26, 2016 (JP) ..... JP2016-146363

(51) Int. Cl.
*F25B 13/00* (2006.01)
*F25B 39/04* (2006.01)
(Continued)

(52) U.S. Cl.
CPC ..... *F25B 13/00* (2013.01); *F25B 1/00* (2013.01); *F25B 6/04* (2013.01); *F25B 29/00* (2013.01);
(Continued)

(58) Field of Classification Search
CPC .... F25B 1/00; F25B 6/04; F25B 13/00; F25B 29/00; F25B 39/04; F25B 41/046; F25B 41/06
See application file for complete search history.

(56) References Cited

U.S. PATENT DOCUMENTS 5,813,249 A * 9/1998 Matsuo ..... B60H 1/3229 165/132
2011/0036113 A1* 2/2011 Kopko ..... F25B 30/02 62/324.5
(Continued)

FOREIGN PATENT DOCUMENTS

JP S50043346 U 5/1975
JP S5229344 A 7/1977
(Continued)

*Primary Examiner* — Marc E Norman
(74) *Attorney, Agent, or Firm* — Harness, Dickey & Pierce, P.L.C.

(57) ABSTRACT

A refrigeration cycle device includes a compressor, a condenser, a first decompressor, an outside heat exchanger, and an evaporator. A predetermined part of a refrigerant passage from the condenser to the first decompressor through which the refrigerant flows is a condenser outlet portion. A predetermined part of a refrigerant passage from the first decompressor to the outside heat exchanger through which the refrigerant flows is an outside heat exchanger inlet portion. A predetermined part of a refrigerant passage from the outside heat exchanger to the second decompressor through which the refrigerant flows is an outside heat exchanger outlet portion. A volume capacity of the condenser outlet portion is larger than a volume capacity of the outside heat exchanger inlet portion. According to the refrigeration cycle device, preferable coefficient of performance of cycle can be achieved in different operation modes.

3 Claims, 30 Drawing Sheets

(51) Int. Cl.

| | |
|---|---|
| ***F25B 6/04*** | (2006.01) |
| ***F25B 41/06*** | (2006.01) |
| ***F25B 1/00*** | (2006.01) |
| ***F25B 29/00*** | (2006.01) |
| ***F25B 41/04*** | (2006.01) |

(52) U.S. Cl.
CPC ..... *F25B 39/04* (2013.01); *F25B 41/046* (2013.01); *F25B 41/06* (2013.01)

(56) References Cited

U.S. PATENT DOCUMENTS

| | | | | |
|---|---|---|---|---|
| 2012/0255319 | A1 | 10/2012 | Itoh et al. | |
| 2013/0305764 | A1* | 11/2013 | Korenaga ..... | F25B 43/00 62/324.6 |
| 2015/0159933 | A1 | 6/2015 | Itoh et al. | |
| 2015/0323225 | A1* | 11/2015 | Matsumoto ..... | F25B 39/00 62/324.1 |

FOREIGN PATENT DOCUMENTS

| | | | |
|---|---|---|---|
| JP | S5229344 | Y2 | 7/1977 |
| JP | H02082060 | A | 3/1990 |
| JP | 2000055483 | A | 2/2000 |
| JP | 2003207219 | A | 7/2003 |
| JP | 2003254641 | A | 9/2003 |
| JP | 2006284074 | A | 10/2006 |
| JP | 2007255730 | A | 10/2007 |
| JP | 2012225637 | A | 11/2012 |
| JP | 2014119150 | A | 6/2014 |
| WO | WO-2017098795 | A1 | 6/2017 |

* cited by examiner

REFRIGERATION CYCLE DEVICE

CROSS REFERENCE TO RELATED APPLICATION

The present application is a continuation application of International Patent Application No. PCT/JP2017/025870 filed on Jul. 18, 2017, which designated the United States and claims the benefit of priority from Japanese Patent Application No. 2016-146363 filed on Jul. 26, 2016. The entire disclosures of all of the above applications are incorporated herein by reference.

TECHNICAL FIELD

The present disclosure relates to a refrigeration cycle device in which a refrigerant is condensed and evaporated.

BACKGROUND

A refrigeration cycle device is known, in which a compressor, a condenser, a first expansion valve, an outside heat exchanger, a second expansion valve, and an evaporator are connected in series.

In this refrigeration cycle device, a cooling mode and a heating mode are switched by adjusting an opening degree of the first expansion valve and the second expansion valve, for example.

In the cooling mode, the gas-phase refrigerant is condensed in the outside heat exchanger to be the liquid-phase refrigerant, and the liquid-phase refrigerant is evaporated in the evaporator to be the gas-phase refrigerant. In the heating mode, the gas-phase refrigerant is condensed in the condenser to be the liquid-phase refrigerant, and the liquid-phase refrigerant is evaporated in the outside heat exchanger to be the gas-phase refrigerant.

SUMMARY

A refrigeration device according to an aspect of the present disclosure includes a compressor configured to draw a refrigerant and to discharge the refrigerant after compressing the refrigerant, a condenser configured to condense the refrigerant discharged from the compressor by heat exchange, a first decompressor configured to decompress and expand the refrigerant flowing out of the condenser, an outside heat exchanger configured to exchange heat between outside air and the refrigerant flowing out of the first decompressor, a second decompressor configured to decompress and expand the refrigerant flowing out of the outside heat exchanger, and an evaporator configured to evaporate the refrigerant flowing out of the second decompressor by heat exchange. A predetermined part of a refrigerant passage from the condenser to the first decompressor through which the refrigerant flows is a condenser outlet portion. A predetermined part of a refrigerant passage from the first decompressor to the outside heat exchanger through which the refrigerant flows is an outside heat exchanger inlet portion. A predetermined part of a refrigerant passage from the outside heat exchanger to the second decompressor through which the refrigerant flows is an outside heat exchanger outlet portion.

EMBODIMENTS

Figure 1:
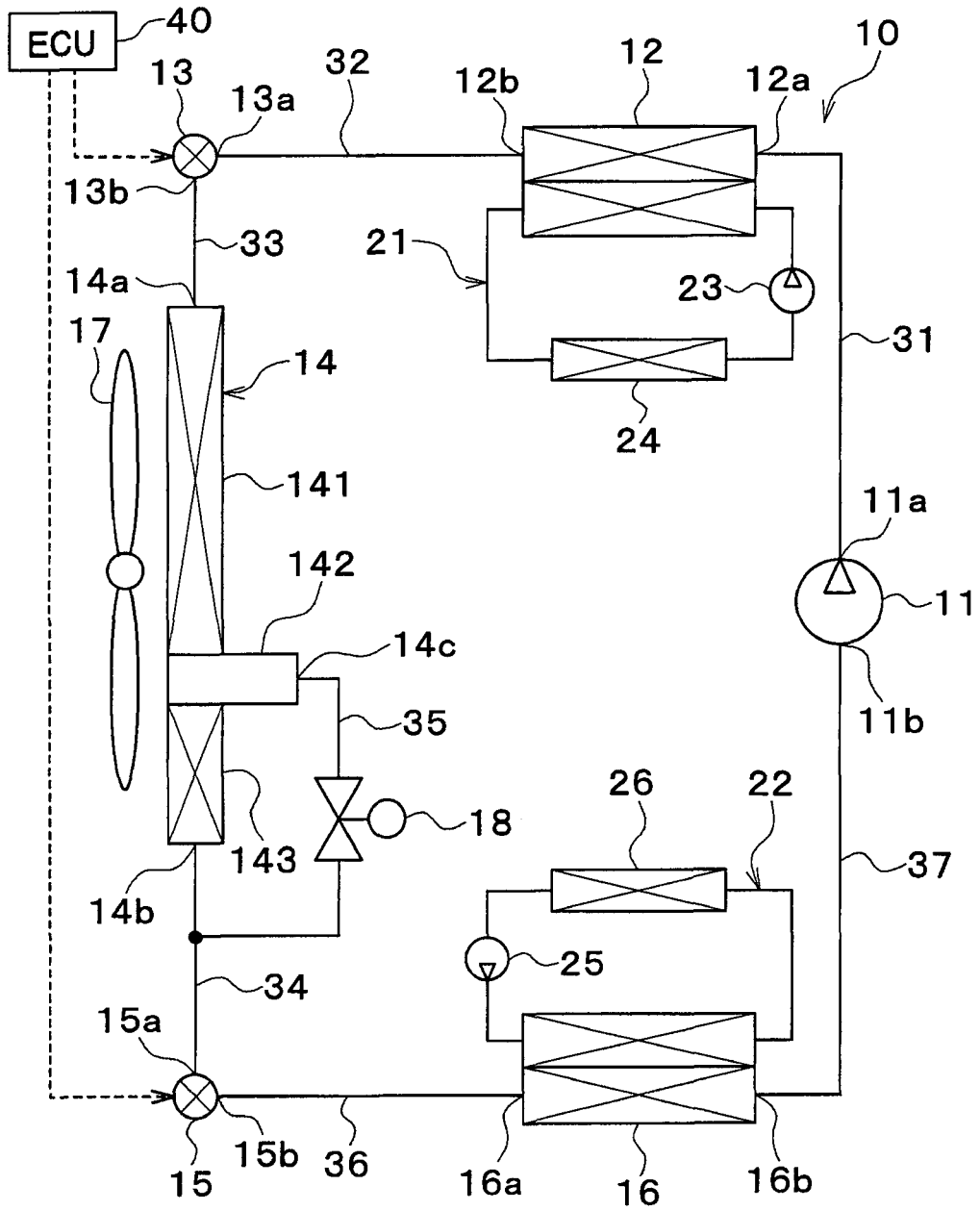
FIG. 1 is a diagram schematically illustrating an overall configuration of a refrigeration cycle device of at least one embodiment of the present disclosure.

Hereinafter, embodiments for implementing the present disclosure will be described referring to drawings. In each embodiment, portions corresponding to the elements described in the preceding embodiments are denoted by the same reference numerals, and redundant explanation may be omitted. In each of the embodiments, when only a part of the configuration is described, the other parts of the configuration can be applied to the other embodiments described above. The parts may be combined even if it is not explicitly described that the parts can be combined. The embodiments may be partially combined even if it is not explicitly described that the embodiments can be combined, provided there is no harm in the combination.

Hereinafter, embodiments will be described with reference to the drawings. In the following embodiments, identical or equivalent elements are denoted by the same reference numerals as each other in the figures.

First Embodiment

The inventors have studied about a refrigeration cycle of a comparative example, in which a compressor, a condenser, a first expansion valve, an outside heat exchanger, a second expansion valve, and an evaporator are connected in series.

In the comparative example, a cooling mode and a heating mode are switched by adjusting an opening degree of the first expansion valve and the second expansion valve, for example.

In the comparative example, the amount of the refrigerant at which a cycle coefficient of performance (COP) is appropriate is different in the cooling mode and the heating mode.

For example, since the refrigerant pressure in the cooling mode is higher than that in the heating mode, the density of the refrigerant in the cooling mode is higher than that in the heating mode. Accordingly, the required refrigerant amount (appropriate refrigerant amount) is larger in the cooling mode than that in the heating mode.

Further, in the comparative example, since the phase state (i.e. liquid phase, gas-liquid two phase, and gas phase) is different in the cooling mode and the heating mode in some refrigerant pipes, the refrigerant amount required in such refrigerant pipes is different in the cooling mode and the heating mode. Such refrigerant pipes in which the phase state of the refrigerant is different in the cooling mode and the heating mode may cause the difference of the required refrigerant amount (appropriate refrigerant amount).

A refrigeration cycle device 10 illustrated in FIG. 1 is a refrigeration cycle device for a vehicle which is used for adjusting temperature of an inside space of the vehicle to be appropriate. In the present embodiment, the refrigeration cycle device 10 is applied to a hybrid vehicle that obtains driving force for moving the vehicle from an engine (internal combustion engine) and an electric motor.

The hybrid vehicle in the present embodiment is configured as a plug-in hybrid vehicle that is configured to charge a battery (a vehicle mounted battery) mounted to the vehicle with power supplied from an external power source (commercial power supply) while the vehicle is stopped. For example, the battery may be a lithium ion battery.

The driving force generated by the engine is used for actuating a motor generator, and for moving the vehicle as well. The electric power generated by the generator or supplied from the external power source can be stored in the battery, and the stored electric power is supplied to not only the electric motor for traveling but vehicle components such as electric components constituting the refrigeration cycle device 10.

The refrigeration cycle device 10 is an vapor-compression refrigerator including a compressor 11, a condenser 12, a first expansion valve 13, an outside heat exchanger 14, a second expansion valve 15, and the evaporator 16. According to the refrigeration cycle device 10 of the present embodiment, a fluorocarbon refrigerant is adopted as the refrigerant to constitute a subcritical refrigeration cycle in which a high-pressure side refrigerant pressure does not exceed a critical pressure of the refrigerant.

The compressor 11, the condenser 12, the first expansion valve 13, the outside heat exchanger 14, the second expansion valve 15, and the evaporator 16 are connected in series with respect to the flow of the refrigerant.

The compressor 11 is an electric compressor driven by power supplied from the battery or a variable capacity compressor driven by a belt. The compressor is configured to draw, compresses, and discharges the refrigerant in the refrigeration cycle device 10.

The condenser 12 serves as a condenser that is configured to condense the high-pressure refrigerant by performing a heat exchange between the high-pressure refrigerant discharged from the compressor 11 and the coolant in a high-temperature coolant circuit 21.

The coolant in the high-temperature coolant circuit 21 is a fluid serving as a heat medium. The coolant in the high-temperature coolant circuit 21 is a high-temperature heat medium. As the coolant in the high-temperature coolant circuit 21, a liquid containing at least ethylene glycol, dimethylpolysiloxane, or nanofluid, or anti-freezing liquid may be used.

The first expansion valve 13 serves as a first decompressor that is configured to decompress and expand a liquid-phase refrigerant flowing out of the condenser 12. The first expansion valve 13 is an electric-type variable throttle mechanism, and has a valve body and an electric actuator.

The valve body is configured change the passage opening degree (throttle opening degree) of the refrigerant passage. The electric actuator includes a stepper motor configured to change the throttle opening degree of the valve body.

The first expansion valve 13 is constituted by a variable throttle mechanism that has a full-open function for fully opening the refrigerant passage when the throttle opening degree is full-opened. That is, the first expansion valve 13 does not decompress the refrigerant when the first expansion valve 13 fully opens the refrigerant passage. An operation of the first expansion valve 13 is controlled by a control signal output from a controller 40.

The outside heat exchanger 14 is a refrigerant outside air heat exchanger configured to exchange heat between the outside air and the refrigerant flowing out of the first expansion valve 13. The outside air is sent to the outside heat exchanger 14 by the outside blower 17.

The outside blower 17 is a blowing portion configured to send the outside air toward the outside heat exchanger 14. The outside blower 17 is an electric blower in which blades are driven by an electric motor. The outside heat exchanger 14 and the outside blower 17 are located in the foremost part of the vehicle. Accordingly, when the vehicle is traveling, the running wind can be applied to the outside heat exchanger 14.

When the temperature of the refrigerant flowing through the outside heat exchanger 14 is lower than the temperature of the outside air, the outside heat exchanger 14 functions as a heat absorber that causes the refrigerant to absorb heat from the outside air. When the temperature of the refrigerant flowing through the outside heat exchanger 14 is higher than the temperature of the outside air, the outside heat exchanger 14 functions as a radiator that radiates heat from the refrigerant to the outside air.

The second expansion valve 15 serves as a second decompressor that is configured to decompress and expand a liquid-phase refrigerant flowing out of the outside heat exchanger 14. The second expansion valve 15 is an electric-type variable throttle mechanism, and has a valve body and an electric actuator. The valve body is configured to change the passage opening degree (throttle opening degree) of the refrigerant passage. The electric actuator includes a stepper motor configured to change the throttle opening degree of the valve body.

The second expansion valve 15 is constituted by a variable throttle mechanism that has a full-open function for fully-opening the refrigerant passage when the throttle opening is fully-opened. That is, the second expansion valve 15 does not decompress the refrigerant when the second expansion valve 15 fully opens the refrigerant passage. The operation of the second expansion valve 15 is controlled by a control signal output from the controller 40.

The cooling mode and the heating mode are switched by changing the throttle opening degree of the first expansion valve 13 and the second expansion valve 15. The cooling mode is a first mode in which the outside heat exchanger 14 causes the refrigerant to radiate heat. The heating mode is a second mode in which the outside heat exchanger 14 causes the refrigerant to absorb heat.

The first expansion valve 13 and the second expansion valve 15 are operation mode switching portions configured to switch between the cooling mode and the heating mode.

The evaporator 16 is an evaporator configured to evaporate a low-pressure refrigerant by exchanging heat between the low-pressure refrigerant flowing out of the second expansion valve 15 and the coolant in a low-temperature coolant circuit 22. The gas-phase refrigerant evaporated in the evaporator 16 is drawn into and compressed by the compressor 11.

The coolant in the low-temperature coolant circuit 22 is a fluid serving as a heat medium. The coolant in the low-temperature coolant circuit 22 is a low-temperature heat medium. As the coolant in the low-temperature coolant circuit 22, a liquid containing at least ethylene glycol, dimethylpolysiloxane, or nanofluid, or anti-freezing liquid may be used.

A condenser inlet pipe 31 is between a refrigerant discharge port 11*a* of the compressor 11 and a refrigerant inlet 12*a* of the condenser 12. A condenser outlet pipe 32 is between a refrigerant outlet 12*b* of the condenser 12 and a refrigerant inlet 13*a* of the first expansion valve 13. An outside heat exchanger inlet pipe 33 is between a refrigerant outlet 13*b* of the first expansion valve 13 and a refrigerant inlet 14*a* of the outside heat exchanger 14.

The outside heat exchanger 14 includes a heat exchange portion 141. An outside heat exchanger liquid reservoir 142 and an outside heat exchanger subcooling portion 143 are integrated with the outside heat exchanger 14. The heat exchange portion 141 of the outside heat exchanger 14 is configured to exchange heat between the outside air and the refrigerant flowing out of the first expansion valve 13. The outside heat exchanger liquid reservoir 142 of the outside heat exchanger 14 is a refrigerant reservoir configured to separate the refrigerant flowing out of the heat exchange portion 141 of the outside heat exchanger 14 into gas refrigerant and liquid refrigerant and to store excess refrigerant. The outside heat exchanger subcooling portion 143 of the outside heat exchanger 14 is configured to subcool the liquid-phase refrigerant by exchanging heat between the outside air and the liquid-phase refrigerant flowing out of the outside heat exchanger liquid reservoir 142 of the outside heat exchanger 14 in the cooling mode.

The heat exchange portion 141 has the refrigerant inlet 14*a* of the outside heat exchanger 14. The outside heat exchanger subcooling portion 143 has the first refrigerant outlet 14*b* of the outside heat exchanger 14. The outside heat exchanger liquid reservoir 142 has the second refrigerant outlet 14*c* of the outside heat exchanger 14.

A subcooling portion outlet pipe 34 is between the first refrigerant outlet 14*b* of the outside heat exchanger 14 and the refrigerant inlet 15*a* of the second expansion valve 15.

A subcooling portion bypass pipe 35 is between the second refrigerant outlet 14*c* of the outside heat exchanger 14 and the subcooling portion outlet pipe 34. The subcooling portion bypass pipe 35 is a bypass portion through which the refrigerant flowing through the outside heat exchanger liquid reservoir 142 of the outside heat exchanger 14 bypasses the outside heat exchanger subcooling portion 143.

The subcooling portion outlet pipe 34 and the subcooling portion bypass pipe 35 are outside heat exchanger outlet pipes that connect the refrigerant outlets 14*b*, 14*c* of the outside heat exchanger 14 and the refrigerant inlet 15*a* of the second expansion valve 15.

A subcooling bypass on-off valve 18 is provided in the subcooling portion bypass pipe 35. The subcooling bypass on-off valve 18 is a bypass opening degree adjusting portion configured to adjust the passage opening degree of the subcooling portion bypass pipe 35. The subcooling bypass on-off valve 18 is an electromagnetic valve controlled by the controller 40.

An evaporator inlet pipe 36 is between a refrigerant outlet 15*b* of the second expansion valve 15 and a refrigerant inlet 16*a* of the evaporator 16.

An evaporator outlet pipe 37 is between a refrigerant outlet 16*b* of the evaporator 16 and a refrigerant intake port 11*b* of the compressor 11.

The condenser 12, a high-temperature side pump 23, and a heater core 24 are provided in the high-temperature coolant circuit 21. The evaporator 16, a low-temperature side pump 25, and a cooler core 26 are provided in the low-temperature coolant circuit 22.

The high-temperature side pump 23 and the low-temperature side pump 25 are heat medium pumps configured to draw and discharge the coolant. The high-temperature side pump 23 and the low-temperature side pump 25 are electric pumps. The high-temperature side pump 23 is a high-temperature side flow rate adjusting portion configured to adjust the flow rate of the coolant circulating in the high-temperature coolant circuit 21. The low-temperature side pump 25 is a low-temperature side flow rate adjusting portion configured to adjust the flow rate of the coolant circulating in the low-temperature coolant circuit 22.

The heater core 24 is a high-temperature side heat medium heat exchanger that is configured to perform a heat exchange between the coolant in the high-temperature coolant circuit 21 and the air supplied to the vehicle compartment thereby heating the air supplied to the vehicle compartment. In the heater core 24, the coolant radiates heat to the air sent to the passenger compartment by using sensible heat. That is, in the heater core 24, the phase of the coolant does not change from the liquid-phase even when the coolant radiates heat to the air sent to the passenger compartment.

The cooler core 26 is a low-temperature side heat medium heat exchanger that is configured to perform a heat exchange between the coolant in the low-temperature coolant circuit 22 and the air sent to the vehicle compartment thereby cooling the air supplied to the vehicle compartment. In the cooler core 26, the coolant absorbs heat from the air sent to the passenger compartment by using sensible heat. That is, in the cooler core 26, the phase of the coolant does not change from the liquid-phase even when the coolant absorbs heat from the air sent to the passenger compartment.

The cooler core 26 and the heater core 24 are housed in a casing (hereinafter, referred to as an air-conditioning casing) of an inside air-conditioning unit that is not shown. The air-conditioning casing is an air-passage forming member that defines an air passage therein.

The heater core 24 is positioned downstream of the cooler core 26 in a flow direction of the air in the air passage inside the air-conditioning casing. The air-conditioning casing is located in an inside space of the vehicle.

An inside-outside air switching case (not shown) and an inside blower (not shown) are arranged in the air-conditioning casing. The inside-outside air switching case serves as an inside-outside air switching unit that introduces inside air and outside air into the air passage inside the air-conditioning casing selectively. The inside blower is configured to selectively draw an inside air and an outside air introduced into an air passage defined in the air conditioning case via the inside-outside air switching case.

An air mix door (not shown) is positioned between the cooler core 26 and the heater core 24 in the air passage inside the air-conditioning casing. The air mix door adjusts a ratio between a volume of cool air, which flows into the heater core 24 after passing through the cooler core 26, and a volume of cool air, which bypasses the heater core 24 after passing through the cooler core 26.

The air mix door is a rotary door that includes a rotary shaft and a door body. The rotary shaft is supported by the air-conditioning casing to be rotatable. The door body is coupled with the rotary shaft. A temperature of conditioned air, which is discharged from the air conditioning case into the passenger compartment, can be adjusted to a desired temperature by adjusting an opening position of the air mix door.

The rotary shaft of the air mix door is driven by a servomotor. The operation of the servomotor is controlled by the controller 40.

The controller 40 includes a known microcomputer including CPU, ROM, RAM and the like, and peripheral circuits. The controller 40 performs various calculations and processes based on a control program stored in the ROM. Various control target devices are connected to an output side of the controller 40. The controller 40 is a control unit that controls the control target devices.

Control target devices controlled by the controller 40 includes the compressor 11, the first expansion valve 13, the second expansion valve 15, the outside blower 17, the subcooling bypass on-off valve 18, the high-temperature side pump 23, and the low-temperature side pump 25.

In the controller 40, the software and hardware for controlling the electric motor of the compressor 11 is a refrigerant discharge capacity controller. In the controller 40, the software and hardware for controlling the first expansion valve 13 is a first throttle controller. In the controller 40, the software and hardware for controlling the second expansion valve 15 is a second throttle controller.

In the controller 40, the software and hardware for controlling the outside blower 17 is an outside air blowing capacity controller. In the controller 40, the software and hardware for controlling the subcooling bypass on-off valve 18 is a bypass opening degree controller.

In the controller 40, the software and hardware for controlling the high-temperature side pump 23 is a high-temperature side heat medium flow rate controller. In the controller 40, the software and hardware for controlling the low-temperature side pump 25 is a low-temperature side heat medium flow rate controller.

Sensors for controlling air-conditioning such as an inside air temperature sensor, an outside air temperature sensor, an irradiance sensor which are not shown in the drawings are connected to an input side of the controller 40.

The inside air temperature sensor detects a passenger compartment temperature Tr. The outside air temperature sensor detects an outside air temperature Tam. The irradiance sensor detects a solar irradiance Ts in the passenger compartment.

Various operation switches (not shown) are connected with the input side of the controller 40. The operation switches are provided on an operation panel (not shown) and controlled by an occupant. The operation panel is located in the vicinity of the instrument panel in the front part of the passenger compartment. Operation signals from the various operation switches are input to the controller 40.

The various operation switches include an air-conditioning switch and a temperature setting switch, for example. The air-conditioning switch is for setting whether or not to perform cooling of the air sent to the passenger compartment by the inside air-conditioning unit. The temperature setting switch is for setting a target temperature of the passenger compartment.

Figure 2:
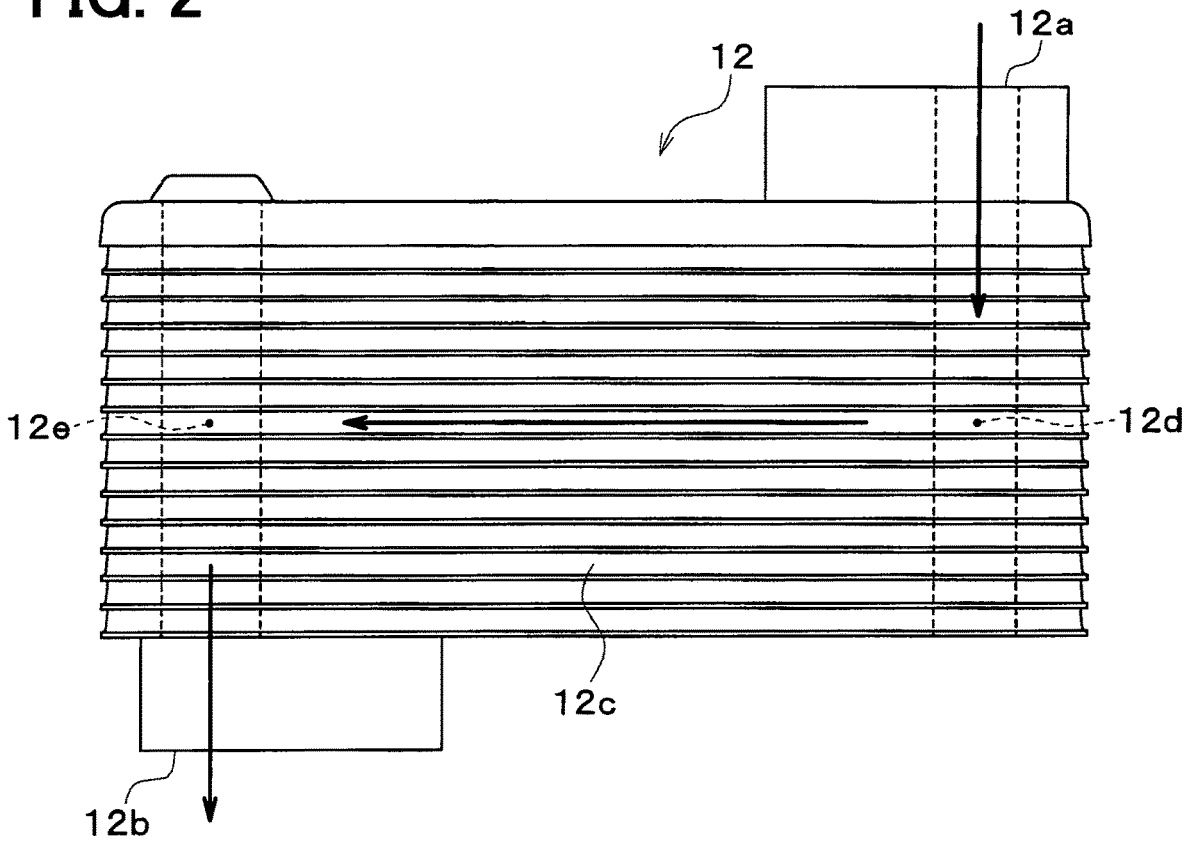
FIG. 2 is a front view of a condenser according to at least one embodiment.

As shown in FIG. 2, the condenser 12 is formed of plate members stacked and joined with each other. Spaces through which the refrigerant flows are defined between the plate members.

The condenser 12 includes a condenser core portion 12*c*, a condenser inlet tank portion 12*d* and a condenser outlet tank portion 12*e*. An arrow of FIG. 2 indicates a flow direction of the refrigerant in the condenser 12.

Multiple refrigerant passages through which the refrigerant flows and multiple coolant passages through which the coolant flows are defined in the condenser core portion 12*c*. The inside space of the condenser inlet tank portion 12*d* is a refrigerant distribution space which communicates with the refrigerant inlet 12*a* of the condenser 12 and distributes the refrigerant to the refrigerant passages of the condenser core portion 12*c*. The inside space of the condenser outlet tank portion 12*e* is a refrigerant collection space which communicates with the refrigerant outlet 12*b* of the condenser 12 and collects the refrigerant flowing through the refrigerant passages of the condenser core portion 12*c*.

Figure 3:
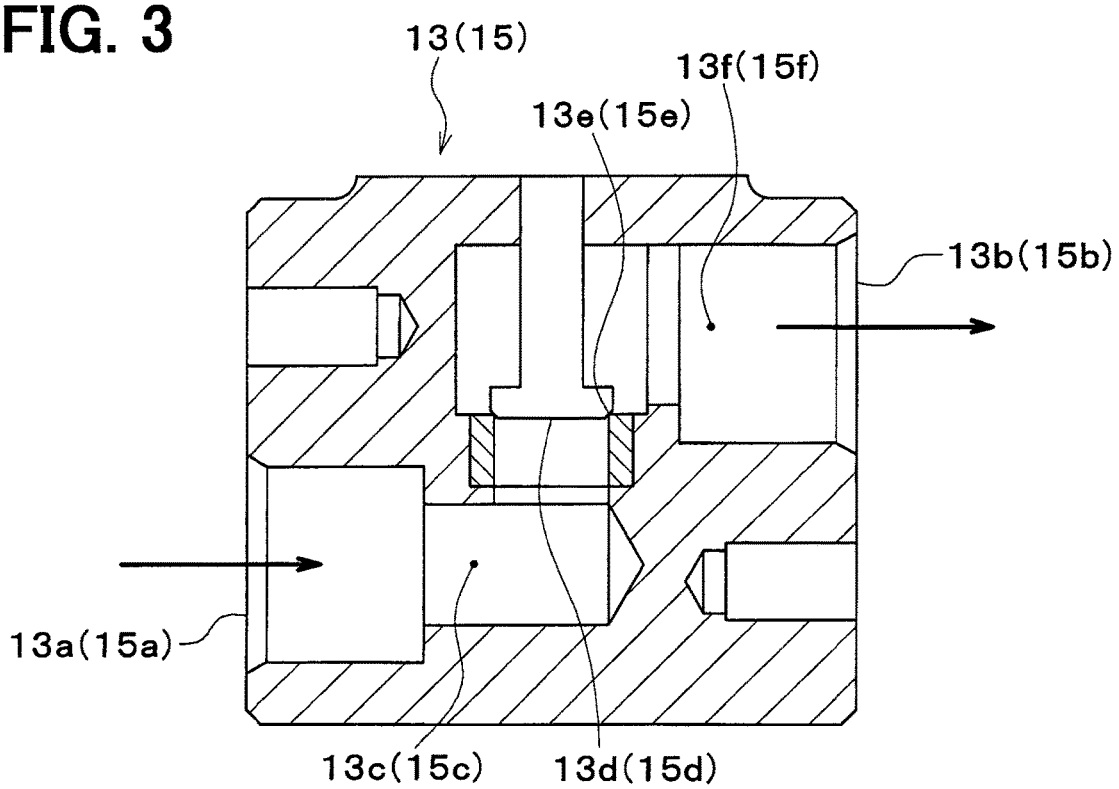
FIG. 3 is a cross-sectional view illustrating a first expansion valve according to at least one embodiment.

The first expansion valve 13 and the second expansion valve 15 have the same basic configuration. Accordingly, the first expansion valve 13 is shown in FIG. 3. The reference numerals corresponding to the second expansion valve 15 are described in parentheses in FIG. 3, and the illustration of the second expansion valve 15 is omitted.

The first expansion valve 13 includes a first inlet passage portion 13*c*, a first valve body 13*d*, a first valve seat 13*e*, and a first outlet passage portion 13*f*. The first valve body 13*d* is a throttle opening degree adjusting portion configured to adjust the throttle opening degree of the first expansion valve 13. That is, the first valve body 13*d* is a decompression amount adjusting portion for adjusting the decompression amount by the first expansion valve 13. The first valve seat 13*e* is a seat for the first valve body 13*d*.

The first inlet passage portion 13*c* is a refrigerant passage located upstream of the first valve seat 13*e* with respect to the flow of the refrigerant. That is, the first inlet passage portion 13*c* is a refrigerant passage of the first expansion valve 13 through which the refrigerant flows before being decompressed. The first inlet passage portion 13*c* is a first decompressor inlet portion.

The first outlet passage portion 13*f* is a refrigerant passage located downstream of the first valve seat 13*e* with respect to the flow of the refrigerant. That is, the first outlet passage portion 13*f* is a refrigerant passage of the first expansion valve 13 through which the refrigerant flows after being decompressed. The first outlet passage portion 13*f* is a first decompressor outlet portion.

Like the first expansion valve 13, the second expansion valve 15 includes a second inlet passage portion 15*c*, a second valve body 15*d*, a second valve seat 15*e*, and a second outlet passage portion 15*f*. The second valve body 15*d* is a throttle opening degree adjusting portion configured to adjust the throttle opening degree of the second expansion valve 15. That is, the second valve body 15*d* is a decompression amount adjusting portion for adjusting the decompression amount by the second expansion valve 15. The second valve seat 15*e* is a seat for the second valve body 15*d*.

The second inlet passage portion 15*c* is located upstream of the second valve seat 15*e* with respect to the flow of the refrigerant. That is, the second inlet passage portion 15*c* is a refrigerant passage of the second expansion valve 15 through which the refrigerant flows before being decompressed. The second inlet passage portion 15*c* is a second decompression inlet portion.

The second outlet passage portion 15*f* is a refrigerant passage located downstream of the second valve seat 15*e* with respect to the flow of the refrigerant. That is, the second outlet passage portion 15*f* is a refrigerant passage of the second expansion valve 15 through which the refrigerant flows after being decompressed. The second outlet passage portion 15*f* is a second decompression outlet portion.

Figure 4:
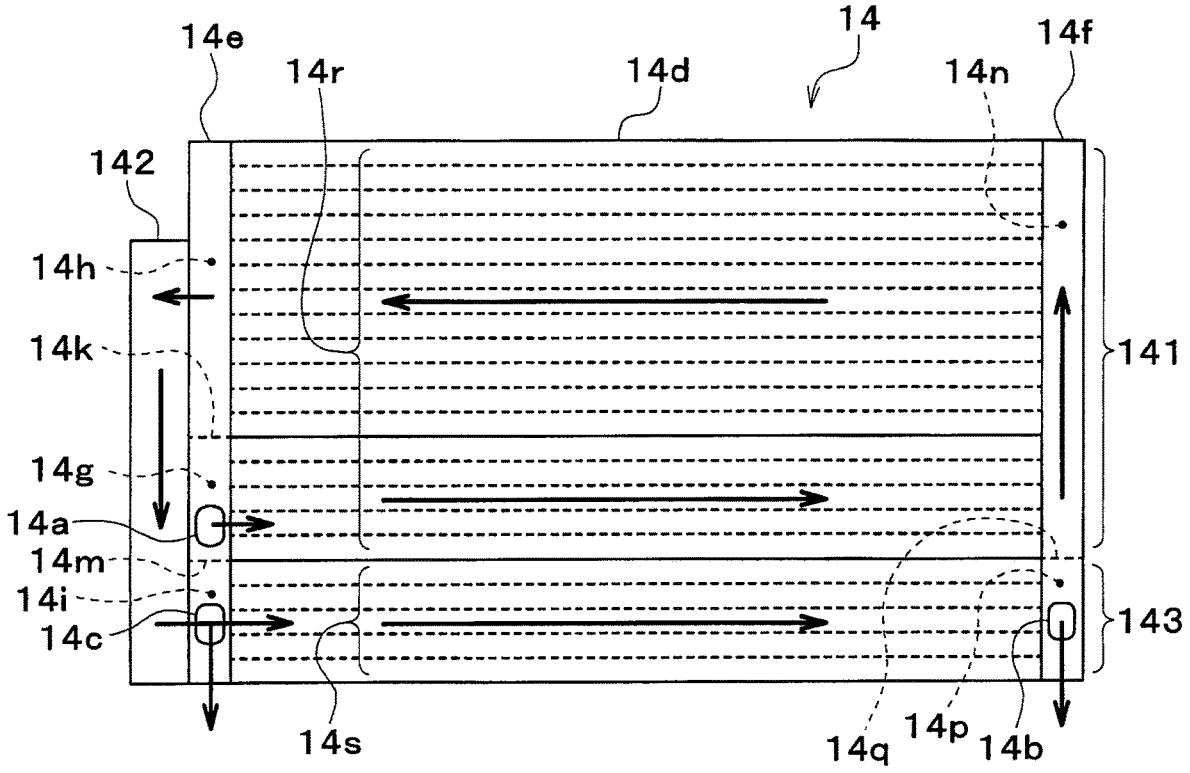
FIG. 4 is a front view illustrating an exterior heat exchanger according to at least one embodiment.

As shown in FIG. 4, the outside heat exchanger 14 includes an outside heat exchanger core portion 14*d*, a first refrigerant tank portion 14*e*, and a second refrigerant tank portion 14*f*. An arrow of FIG. 4 indicates a flow direction of the refrigerant in the outside heat exchanger 14.

The outside heat exchanger core portion 14*d* includes multiple tubes and multiple fins. Multiple tubes and multiple fins are alternately stacked and joined with each other. The gaps between the tubes and the fins are outside air passages through which the outside air flows.

The tube is a refrigerant passage forming member that defines the refrigerant passage therein. The fin is a heat exchange enhancing member configured to enhance heat exchange between the refrigerant and the outside air by increasing a heat transfer area.

The first refrigerant tank portion 14*e* includes a heat exchange portion inlet tank portion 14*g*, a heat exchange portion outlet tank portion 14*h*, and a subcooling portion inlet tank portion 14*i*. The inside spaces of the heat exchange portion inlet tank portion 14*g*, the heat exchange portion outlet tank portion 14*h*, and the subcooling portion inlet tank portion 14*i* are separated from each other by two partition portions 14*k*, 14*m*.

The heat exchange portion inlet tank portion 14*g* includes the refrigerant inlet 14*a*. The inside space of the heat exchange portion outlet tank portion 14*h* communicates with the inside space of the outside heat exchanger liquid reservoir 142 through a communication hole that is not shown. The inside space of the subcooling portion inlet tank portion 14*i* communicates with the inside space of the outside heat exchanger liquid reservoir 142 through a communication hole that is not shown. The subcooling portion inlet tank portion 14*i* includes the second refrigerant outlet 14*c*.

The refrigerant is distributed to the tubes of the outside heat exchanger core portion 14*d* from the heat exchange portion inlet tank portion 14*g* and the subcooling inlet tank portion 14*i*. The refrigerant flowing through the tubes of the outside heat exchanger core portion 14*d* is collected in the heat exchange portion outlet tank portion 14*h*.

The second refrigerant tank portion 14*f* includes a heat exchange portion center tank portion 14*n* and a subcooling portion outlet tank portion 14*p*. The inside spaces of the heat exchange portion center tank portion 14*n* and the subcooling portion outlet tank portion 14*p* are separated from each other by a partition portion 14*q*. The subcooling portion outlet tank portion 14*p* includes the first refrigerant outlet 14*b*.

The heat exchange portion center tank portion 14*n* is configured to collect the refrigerant flowing through the tubes of the outside heat exchanger core portion 14*d* and distribute the refrigerant to the tubes of the outside heat exchanger core portion 14*d*. The refrigerant flowing through the tubes of the outside heat exchanger core portion 14*d* is collected in the subcooling portion outlet tank portion 14*p*.

A part of the outside heat exchanger core portion 14*d* between the heat exchange portion inlet tank portion 14*g* and the heat exchange portion outlet tank portion 14*h* is a heat exchange core portion 14*r* of the heat exchange portion 141. The heat exchange core portion 14*r* exchanges heat between the outside air and the refrigerant flowing therein through the refrigerant inlet 14*a* of the outside heat exchanger 14.

A part of the outside heat exchanger core portion 14*d* between the subcooling portion inlet tank portion 14*i* and the subcooling portion outlet tank portion 14*p* is a subcooling core portion 14*s* of the outside heat exchanger subcooling portion 143. The subcooling core portion 14*s* subcools the liquid-phase refrigerant by exchanging heat between the outside air and the liquid-phase refrigerant flowing out of the outside heat exchanger liquid reservoir 142 during the cooling mode.

The heat exchange portion 141 of the outside heat exchanger 14 is constituted by the heat exchange portion inlet tank portion 14*g*, the heat exchange core portion 14*r*, the heat exchange portion center tank portion 14*n*, and the heat exchange portion outlet tank portion 14*h*. The outside heat exchanger subcooling portion 143 of the outside heat exchanger 14 is constituted by the subcooling portion inlet tank portion 14*i*, the subcooling core portion 14*s*, and the subcooling portion outlet tank portion 14*p*.

Next, the operation with the above-described configuration will be described. The controller 40 switches the air-conditioning mode to the heating mode or the cooling mode based on a target blowout temperature TAO, for example.

The target blowout temperature TAO is a target temperature of the air blown into the passenger compartment. The controller 40 may calculate the target blowout temperature TAO based on the following formula.

$$TAO = Kset \times Tset - Kr \times Tr - Kam \times Tam - Ks \times Ts + C$$

In this formula, Tset is a passenger-compartment inside set temperature set by the temperature setting switch of the operation panel, Tr is the inside air temperature detected by the inside air temperature sensor, Tam is the outside air temperature detected by the outside air temperature sensor, and Ts is the amount of solar irradiance detected by the irradiance sensor. Kset, Kr, Kam, and Ks are control gains, and C is a constant for correction.

Next, the operations in the cooling mode and the heating mode will be described. The cooling mode is a first mode in which the outside heat exchanger 14 causes the refrigerant to radiate heat. The heating mode is a second mode in which the outside heat exchanger 14 causes the refrigerant to absorb heat.

(Cooling Mode)

In the cooling mode, the controller 40 controls the first expansion valve 13 to be in a fully open state and the second expansion valve 15 to be in a throttling state. In the cooling mode, the controller 40 stops the high-temperature side pump 23 and actuates the low-temperature side pump 25.

The controller 40 determines operation states (control signals output to various controlled devices) of various controlled devices connected with the controller 40 based on the target blowout temperature TAO and the detection signals from the sensors, for example.

The control signal output to the second expansion valve 15 is determined such that the subcooling degree of the refrigerant passing through the second expansion valve 15 approaches the target subcooling degree at which the coefficient of performance (COP) reaches a maximum value.

The control signal output to the servomotor of the air mix door that is not shown is determined such that the air mix door closes the air passage of the heater core 24, and accordingly all of the blown air passing through the cooler core 26 bypasses the heater core 24.

Figure 5:
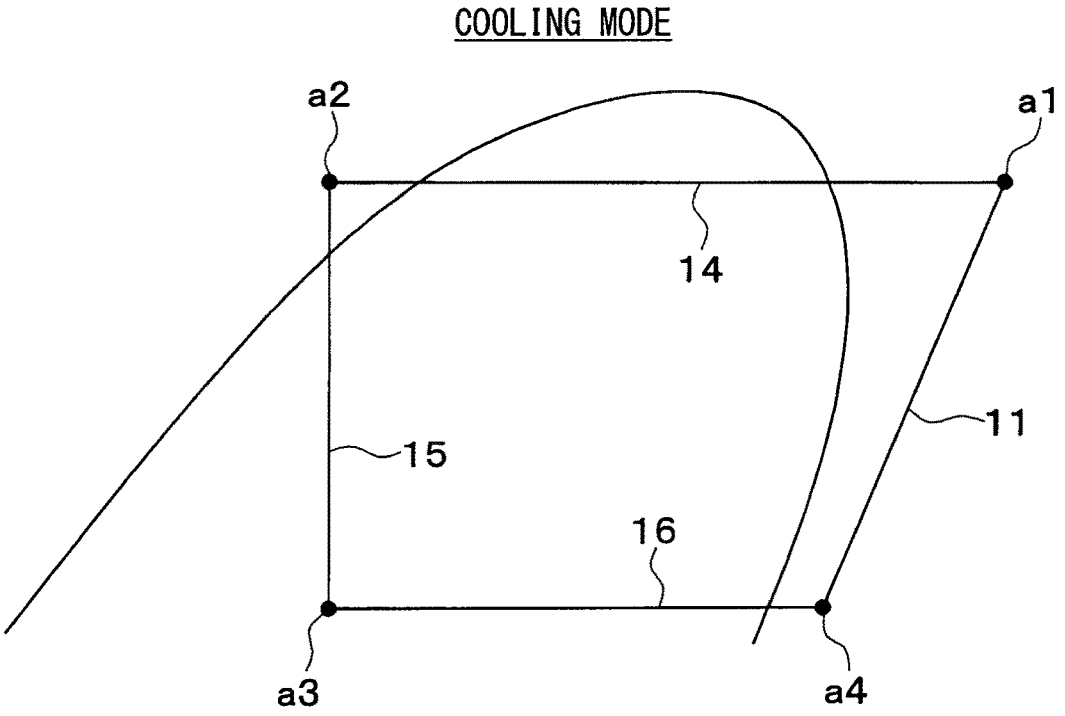
FIG. 5 is a Mollier diagram showing a state of a refrigerant in a cooling mode of the refrigeration cycle device according to at least one embodiment.

According to the refrigeration cycle device 10 in the cooling mode, the state of the refrigerant circulating the cycle changes as shown in the Mollier diagram of FIG. 5.

That is, the high-pressure refrigerant discharged from the compressor 11 flows into the condenser 12 as indicated by a point a1 of FIG. 5. At this time, since the high-temperature side pump 22 stops, the coolant in the high-temperature coolant circuit 21 does not flow through the condenser 12. Accordingly, the refrigerant flowing into the condenser 12 flows out of the condenser 12 almost without exchanging heat with the coolant in the high-temperature coolant circuit 21.

The refrigerant flowing out of the condenser 12 flows into the first expansion valve 13. Since the first expansion valve 13 fully opens the refrigerant passage, the refrigerant flowing out of the condenser 12 flows into the outside heat exchanger 14 without being decompressed by the first expansion valve 13.

As indicated by points a1, a2 of FIG. 5, the refrigerant flowing into the outside heat exchanger 14 radiates heat to the outside air blown by the outside blower 17.

As indicated by points a2, a3 of FIG. 5, the refrigerant flowing out of the outside heat exchanger 14 flows into the second expansion valve 15 and is decompressed to be a low-pressure refrigerant. As indicated by points a3, a4 of FIG. 5, the low-pressure refrigerant decompressed by the second expansion valve 15 flows into the evaporator 16, absorbs heat from the coolant in the low-temperature coolant circuit 22, and is thereby evaporated. Since the coolant in the low-temperature coolant circuit 22 is cooled, the air sent to the passenger compartment is cooled by the cooler core 26.

As indicated by points a4, a1 of FIG. 5, the refrigerant flowing out of the evaporator 16 flows toward the intake side of the compressor 11 and is compressed by the compressor 11 again.

In the outside heat exchanger 14, the refrigerant condensed in the heat exchange portion 141 is separated into gas refrigerant and liquid refrigerant in the outside heat exchanger liquid reservoir 142, and excess liquid refrigerant is stored in the outside heat exchanger liquid reservoir 142. In the cooling mode, the controller 40 closes the subcooling bypass on-off valve 18. According to this, the liquid-phase refrigerant flowing out of the outside heat exchanger liquid reservoir 142 flows through the outside heat exchanger subcooling portion 143 to be subcooled.

As described above, in the cooling mode, the blown air cooled by the cooler core 26 can be blown into the passenger compartment. Accordingly, the cooling of the passenger compartment is performed.

(Heating Mode)

In the heating mode, the controller 40 controls the first expansion valve 13 to be in a throttling state and the second expansion valve 15 to be in a fully open state. In the heating mode, the controller 40 actuates the high-temperature side pump 23 and stops the low-temperature side pump 25.

The controller 40 determines operation states (control signals output to various controlled devices) of various controlled devices connected with the controller 40 based on the target blowout temperature TAO and the detection signals from the sensors, for example.

The control signal output to the first expansion valve 13 is determined such that the subcooling degree of the refrigerant passing through the first expansion valve 13 approaches the predetermined target subcooling degree. The target subcooling degree is set such that the coefficient of performance (COP) reaches a maximum value.

The control signal output to the servomotor of the air mix door that is not shown is determined such that the air mix door fully opens the air passage of the heater core 24, and accordingly all of the blown air passes through the air passage in which the cooler core 26 is provided.

Figure 6:
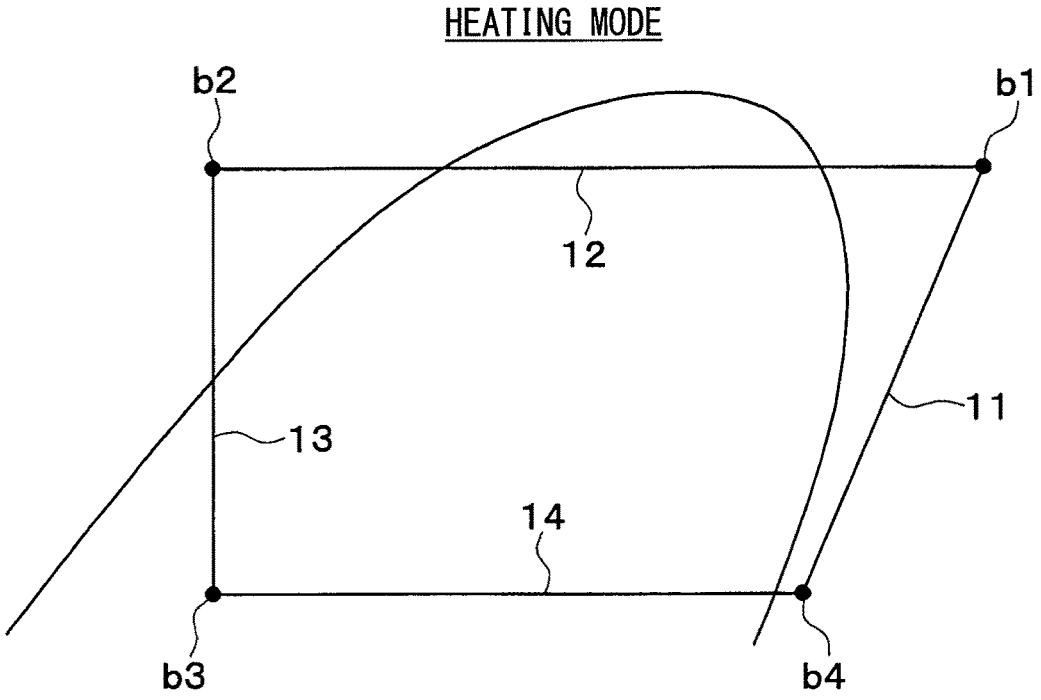
FIG. 6 is a Mollier diagram showing a state of the refrigerant in a heating mode of the refrigeration cycle device according to at least one embodiment.

In the heating mode, the state of the refrigerant circulating the cycle changes as shown in the Mollier diagram of FIG. 6.

That is, as indicated by points b1, b2 of FIG. 6, the high-pressure refrigerant discharged from the compressor 11 flows into the condenser 12 and radiates heat by heat exchange with the coolant in the high-temperature coolant circuit 21. Accordingly, the coolant in the high-temperature coolant circuit 21 is heated.

As indicated by points b2, b3 of FIG. 6, the refrigerant flowing out of the condenser 12 flows into the first expansion valve 13 and is decompressed to be a low-pressure refrigerant. As indicated by points b3, b4 of FIG. 6, the low-pressure refrigerant decompressed by the first expansion valve 13 flows into the outside heat exchanger 14, absorbs heat from the outside air blown by the outside blower 17, and is thereby evaporated.

The refrigerant flowing out of the outside heat exchanger 14 flows into the second expansion valve 15. Since the second expansion valve 15 is in the fully open state, the refrigerant flowing out of the outside heat exchanger 14 flows into the evaporator 16 without being decompressed by the second expansion valve 15.

Since the low-temperature side pump 25 stops, the coolant in the low-temperature coolant circuit 22 does not flow through the evaporator 16. Accordingly, the low-pressure refrigerant flowing into the evaporator 16 hardly absorbs heat from the coolant in the low-temperature coolant circuit 22. As indicated by points b4, b1 of FIG. 6, the refrigerant flowing out of the evaporator 16 flows toward the intake side of the compressor 11 and is compressed by the compressor 11 again.

In the heating mode, the controller 40 opens the subcooling bypass on-off valve 18. According to this, since the refrigerant flowing out of the outside heat exchanger liquid reservoir 142 of the outside heat exchanger 14 flows through the subcooling portion bypass pipe 35, pressure loss of the refrigerant in the outside heat exchanger subcooling portion 143 of the outside heat exchanger 14 can be reduced.

As described above, in the heating mode, the heat of the high-pressure refrigerant discharged by the compressor 11 is radiated to the coolant of the high-temperature coolant circuit 21, and the heat of the coolant of the high-temperature coolant circuit 21 is radiated in the heater core 24 to the air blown toward the passenger compartment. Therefore, the heated air can be blown into the passenger compartment. Accordingly, the heating of the passenger compartment is performed.

As described above, according to the vehicular air-conditioning device 1 of the present embodiment, appropriate cooling and heating of the passenger compartment can be performed by changing the throttle opening degree of the first expansion valve 13 and the second expansion valve 15, and thereby comfortable air-conditioning can be achieved.

In the cooling mode, the gas-phase refrigerant flows through the condenser inlet pipe 31, the condenser outlet pipe 32, and the outside heat exchanger inlet pipe 33. The liquid-phase refrigerant flows through the subcooling portion outlet pipe 34 and the subcooling portion bypass pipe 35. The gas-liquid two-phase refrigerant flows through the evaporator inlet pipe 36. The gas-phase refrigerant flows through the evaporator outlet pipe 37.

In the heating mode, the gas-phase refrigerant flows through the condenser inlet pipe 31. The liquid-phase refrigerant flows through the condenser outlet pipe 32. The gas-liquid two-phase refrigerant flows through the outside heat exchanger inlet pipe 33. The gas-phase refrigerant flows through the subcooling portion outlet pipe 34, the subcooling portion bypass pipe 35, the evaporator inlet pipe 36, and the evaporator outlet pipe 37.

Hereinafter, a predetermined part in parts between the condenser 12 and the first expansion valve 13 through which the refrigerant flows is referred to as a condenser outlet portion. Hereinafter, a predetermined part in parts between the first expansion valve 13 and the outside heat exchanger 14 through which the refrigerant flows is referred to as an outside heat exchanger inlet portion. Hereinafter, a predetermined part in parts between the outside heat exchanger 14 and the second expansion valve 15 through which the refrigerant flows is referred to as an outside heat exchanger outlet portion.

Figure 7:
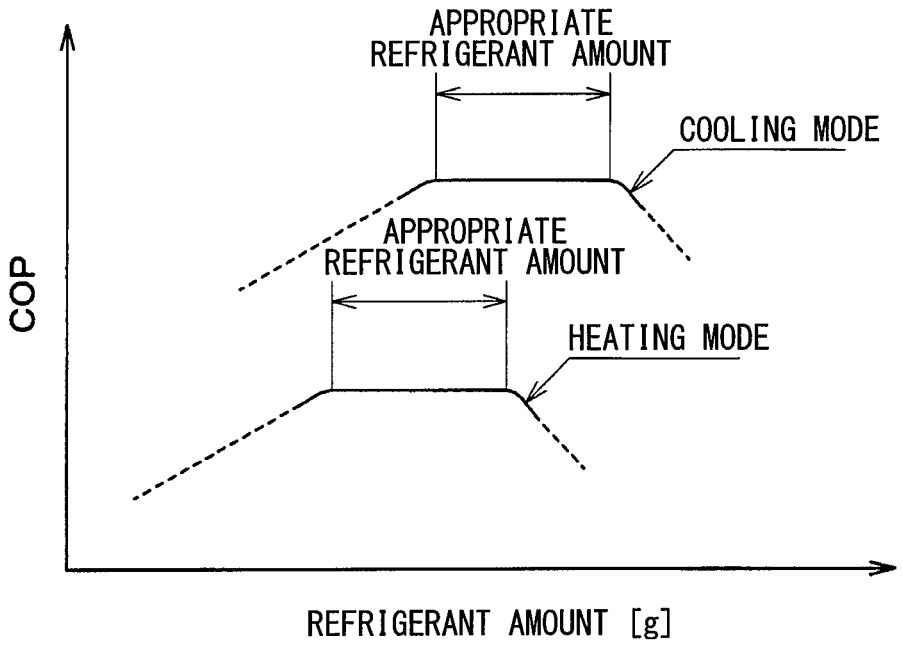
FIG. 7 is a graph showing an appropriate amount of the refrigerant in the cooling mode and the heating mode according to at least one embodiment.

In the present embodiment, a difference in an appropriate refrigerant amount between the cooling mode and the heating mode can be small as shown in FIG. 7 by appropriately setting volume capacities of the condenser outlet portion, the outside heat exchanger inlet portion, and the outside heat exchanger outlet portion, and accordingly the preferable coefficient of performance (COP) of cycle can be achieved in both the cooling mode and the heating mode.

Specifically, in the present embodiment, the volume capacity of the condenser outlet portion is larger than that of the outside heat exchanger inlet portion.

According to this, since the volume capacity of a part through which the liquid-phase refrigerant flows in the heating mode is large compared to a case where the volume capacity of the condenser outlet portion is at or below that of the outside heat exchanger inlet portion, the appropriate refrigerant amount in the heating mode increases. As a result, since the appropriate refrigerant amount in the heating mode approaches the appropriate refrigerant amount in the cooling mode, the difference therebetween can be small, and accordingly the preferable coefficient of performance of cycle can be achieved in both cooling mode and heating mode.

Specifically, in the present embodiment, the volume capacity of the condenser outlet portion is larger than that of the outside heat exchanger outlet portion.

According to this, since the volume capacity of a part through which the liquid-phase refrigerant flows in the heating mode is large and that in the cooling mode is small compared to a case where the volume capacity of the condenser outlet portion is at or below the outside heat exchanger outlet portion, the appropriate refrigerant amount in the heating mode increases and that in the cooling mode decreases. As a result, the difference in the appropriate refrigerant amount between the cooling mode and the heating mode can be small, and accordingly the preferable coefficient of performance of cycle can be achieved in both cooling mode and heating mode.

Figure 8:
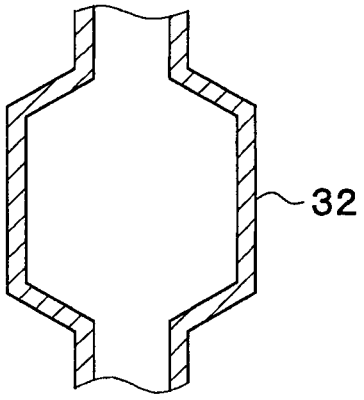
FIG. 8 is a cross-sectional diagram showing one example of a shape of a condenser outlet pipe according to at least one embodiment.

For example, the condenser outlet portion is the condenser outlet pipe 32. Specifically, the above-described relationship of the volume capacity may be satisfied by using a long or thick condenser outlet pipe 32. As shown in FIG. 8, the condenser outlet pipe 32 may be partially thick.

For example, the condenser outlet portion may be the condenser outlet tank portion 12*e* and the first inlet passage portion 13*c*.

For example, the condenser outlet portion may be the condenser outlet tank portion 12*e*, the condenser outlet pipe 32, and the first inlet passage portion 13*c*

For example, the condenser outlet portion may be a part of the condenser 12 in which the refrigerant is in liquid phase and the first inlet passage portion 13*c*. Specifically, the part of the condenser in which the refrigerant is in liquid phase is a part of the heat exchange core portion 12*c* of the condenser 12 in which the refrigerant is in liquid phase and the condenser outlet tank portion 12*e*.

Figure 9:
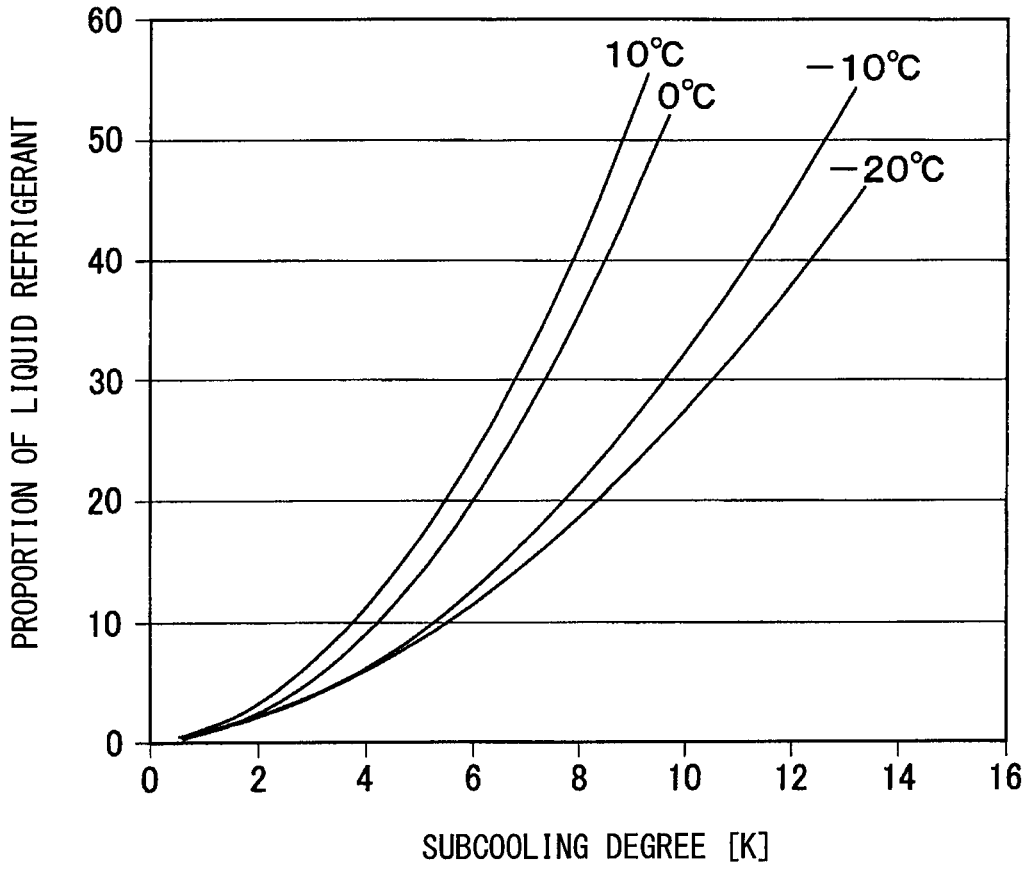
FIG. 9 is a graph showing a relationship between a proportion of a liquid-phase refrigerant in a heat exchange portion of the condenser and a subcooling degree at the condenser outlet, according to at least one embodiment.

FIG. 9 is a graph showing a relationship between a proportion of a liquid-phase refrigerant in a condenser heat exchange portion and a condenser outlet subcooling degree. The proportion of liquid refrigerant in the condenser heat exchange portion is a proportion of the volume of the refrigerant in liquid phase in the heat exchange core portion 12*c* of the condenser 12 divided by the whole part of the heat exchange core portion 12*c* of the condenser 12 through which the refrigerant flows. The condenser outlet subcooling degree is the subcooling degree of the refrigerant at the outlet of the condenser 12.

The proportion of liquid refrigerant in the condenser heat exchange portion may change according to various conditions and is 40-60% at a maximum, 0% at a minimum, 5-25% on average.

When the proportion of liquid refrigerant in the condenser exceeds 40-60%, the performance may be drastically decreased. When the subcooling degree of the refrigerant at the outlet of the condenser 12 is within the appropriate range (e.g. about 2-6 K), the proportion of the liquid refrigerant in the condenser heat exchange portion is between 5-25%.

For example, the condenser outlet portion may be a part of the condenser 12 in which the refrigerant is in liquid phase, the condenser outlet pipe 32, and the first inlet passage portion 13*c*.

For example, the outside heat exchanger inlet portion is the outside heat exchanger inlet pipe 33.

For example, the outside heat exchanger inlet portion may be the first outlet passage portion 13*f* and the heat exchange portion inlet tank portion 14*g*.

For example, the outside heat exchanger inlet portion may be the first outlet passage portion 13*f*, the outside heat exchanger inlet pipe 33, and the heat exchange portion inlet tank portion 14*g*.

For example, the outside heat exchanger outlet portion may be the subcooling portion outlet pipe 34 and the subcooling portion bypass pipe 35.

For example, the outside heat exchanger outlet portion may be the subcooling portion outlet pipe 34, the subcooling portion bypass pipe 35, and the second inlet passage portion 15*c*.

For example, the outside heat exchanger outlet portion may be the subcooling portion inlet tank portion 14*i*, the subcooling portion outlet tank portion 14*p*, the subcooling portion outlet pipe 34, the subcooling portion bypass pipe 35, and the second inlet passage portion 15*c*.

For example, the outside heat exchanger outlet portion may be the heat exchange portion outlet tank portion 14*h*, the subcooling portion inlet tank portion 14*i*, the subcooling core portion 14*s*, the subcooling portion outlet tank portion 14*p*, the subcooling portion outlet pipe 34, the subcooling portion bypass pipe 35, and the second inlet passage portion 15*c*.

For example, the outside heat exchanger outlet portion may be the outside heat exchanger subcooling portion 143, the subcooling portion outlet pipe 34, the subcooling portion bypass pipe 35, and the second inlet passage portion 15*c*.

For example, the outside heat exchanger outlet portion may be the heat exchange portion outlet tank portion 14*h*, the outside heat exchanger liquid reservoir 142, the subcooling portion inlet tank portion 14*i*, the subcooling core portion 14*s*, the subcooling portion outlet tank portion 14*p*, the subcooling portion outlet pipe 34, the subcooling portion bypass pipe 35, and the second inlet passage portion 15*c*.

For example, the outside heat exchanger outlet portion may be the outside heat exchanger liquid reservoir 142, the outside heat exchanger subcooling portion 143, the subcooling portion outlet pipe 34, the subcooling portion bypass pipe 35, and the second inlet passage portion 15*c*.

Second Embodiment

Figure 10:
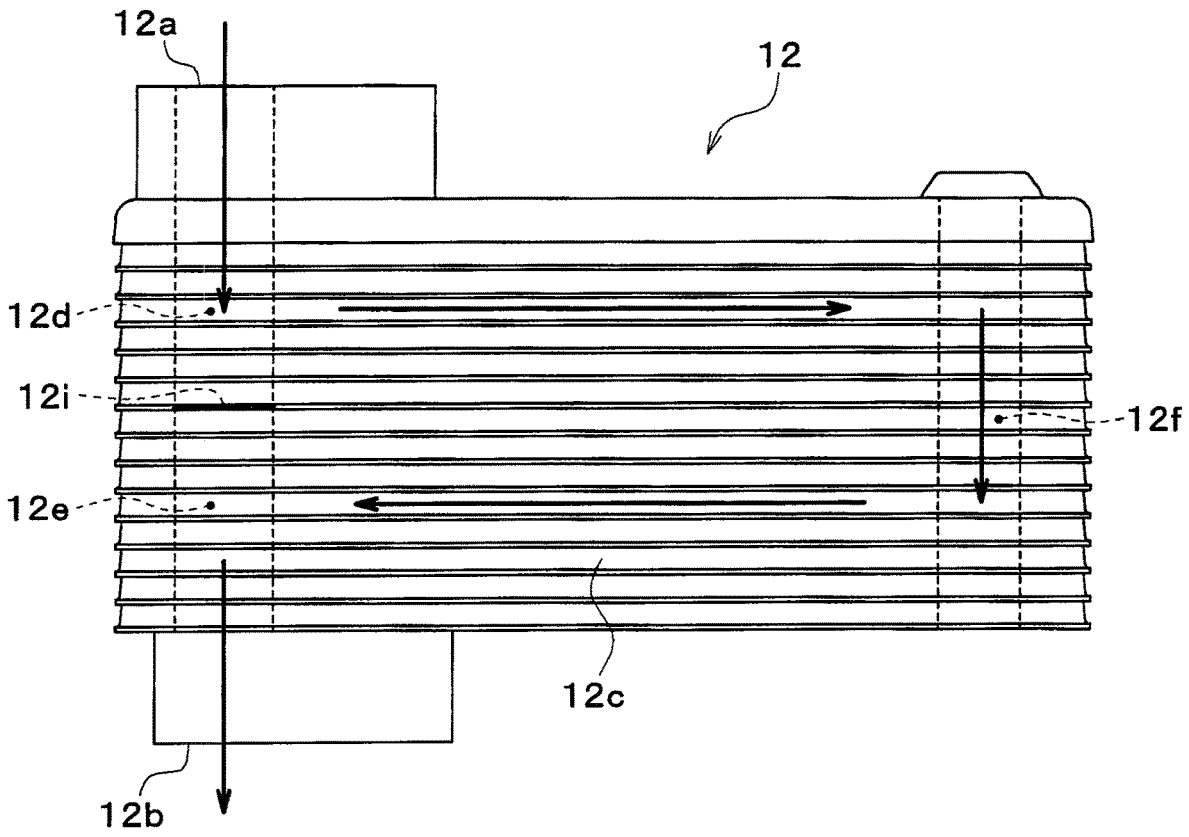
FIG. 10 is a front view of a condenser according to at least one embodiment.

In the above-described first embodiment, the condenser 12 includes the condenser inlet tank portion 12*d* and the condenser outlet tank portion 12*e*. In contrast, in a first example of the present embodiment, the condenser 12 includes the condenser inlet tank portion 12*d*, the condenser outlet tank portion 12*e*, and a condenser center tank portion 12*f* as shown in FIG. 10. Further, in a second example of the present embodiment, the condenser 12 includes the condenser inlet tank portion 12*d*, the condenser outlet tank portion 12*e*, a first center tank portion 12*g*, and a second center tank portion 12*h* as shown in FIG. 11.

In the first example shown in FIG. 10, the condenser inlet tank portion 12*d* and the condenser outlet tank portion 12*e* are partitioned by a partition portion 12*i*. The condenser center tank portion 12*f* distributes the refrigerant to multiple refrigerant passages of the condenser core portion 12*c* and collects the refrigerant flowing through multiple refrigerant passages of the condenser core portion 12*c*.

Figure 11:
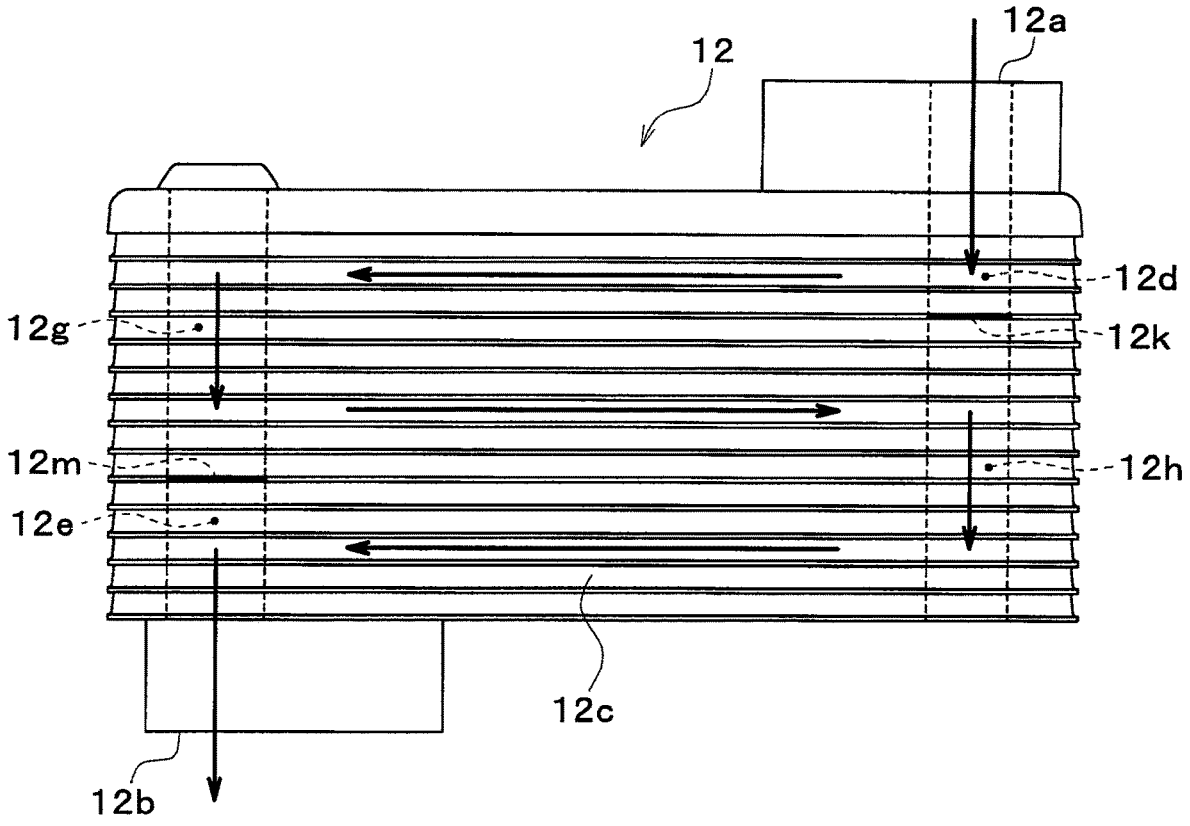
FIG. 11 is a front view of a condenser according to at least one embodiment.
Figure 12:
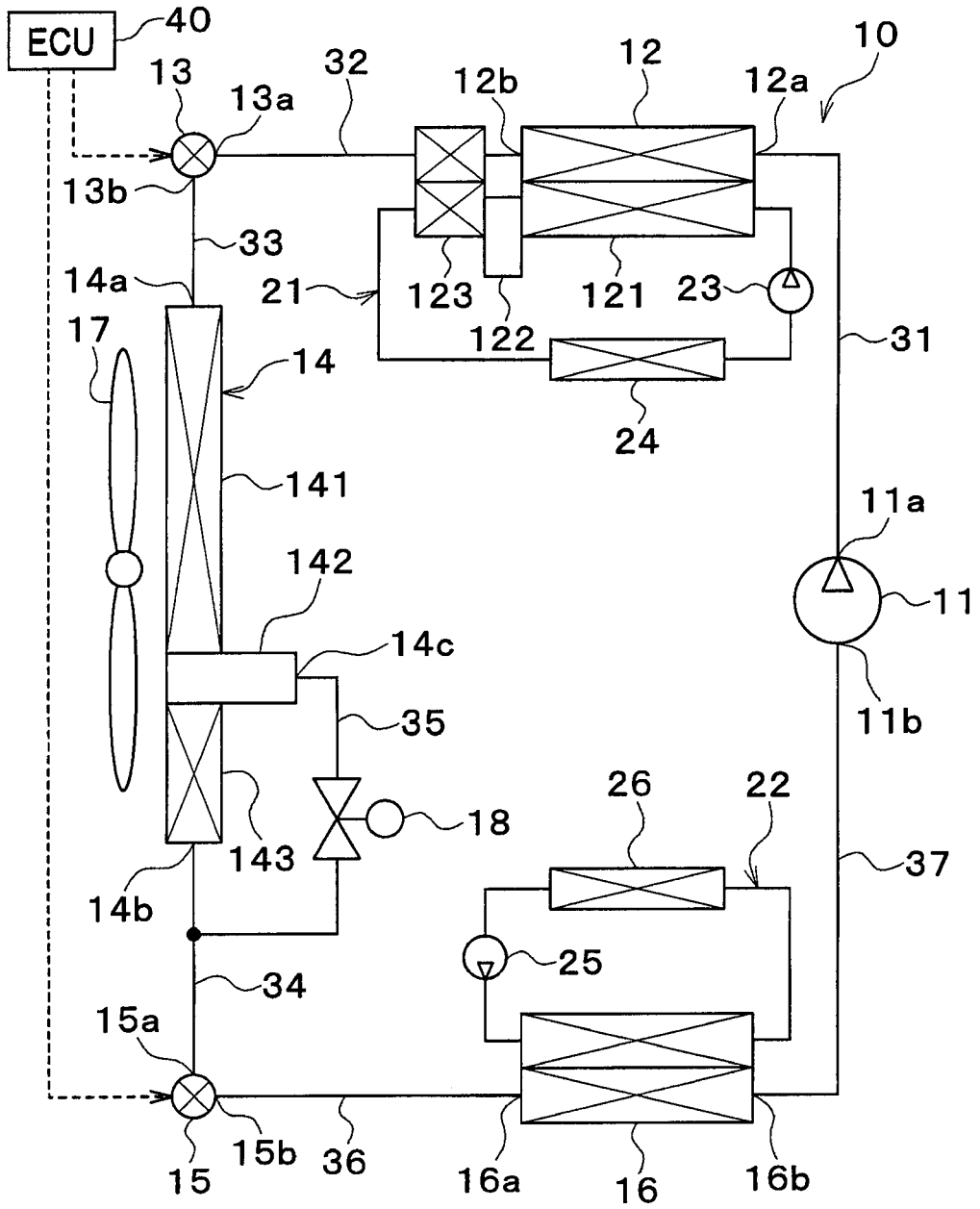
FIG. 12 is a diagram schematically illustrating an overall configuration of a refrigeration cycle device of at least one embodiment of the present disclosure.

In the second example shown in FIG. 11, the condenser inlet tank portion 12*d* and the first center tank portion 12*g* are partitioned by a first partition portion 12*k*, and the condenser outlet tank portion 12*e* and the second center tank portion 12*h* are partitioned by a second partition portion 12*m*. The first center tank portion 12*g* and the second center tank portion 12*h* distribute the refrigerant to multiple refrigerant passages of the condenser core portion 12*c* and collect the refrigerant flowing through multiple refrigerant passages of the condenser core portion 12*c*.

In the present embodiment also, as in the above-described embodiments, a difference in an appropriate refrigerant amount between the cooling mode and the heating mode can be small by appropriately setting volume capacities of the condenser outlet portion, the outside heat exchanger inlet portion, and the outside heat exchanger outlet portion. Accordingly, the preferable coefficient of performance of cycle can be achieved in both the cooling mode and the heating mode.

Third Embodiment

In the present embodiment, the condenser 12 includes a condensing portion 121, a condenser liquid reservoir portion 122, and a condenser subcooling portion 123. The condensing portion 121 condenses the refrigerant discharged from the compressor 11 by exchanging heat with the coolant in the high-temperature coolant circuit 21. The condenser liquid reservoir portion 122 is a refrigerant reservoir configured to separate the refrigerant flowing out of the condensing portion 121 of the condenser 12 into gas refrigerant and liquid refrigerant and to store excess refrigerant. The condenser subcooling portion 123 is configured to subcool the liquid-phase refrigerant by exchanging heat between the coolant in the high-temperature coolant circuit 21 and the liquid-phase refrigerant flowing out of the condenser liquid reservoir portion 122

In the heating mode, the refrigerant condensed in the condensing portion 121 is separated into gas refrigerant and liquid refrigerant in the condenser liquid reservoir portion 122, and excess liquid refrigerant is stored in the condenser liquid reservoir portion 122. The liquid-phase refrigerant flowing out of the condenser liquid reservoir portion 122 flows through the condenser subcooling portion 123 and is subcooled.

In the present embodiment also, as in the above-described embodiments, a difference in an appropriate refrigerant amount between the cooling mode and the heating mode can be small by appropriately setting volume capacities of the condenser outlet portion, the outside heat exchanger inlet portion, and the outside heat exchanger outlet portion. Accordingly, the preferable coefficient of performance of cycle can be achieved in both the cooling mode and the heating mode.

For example, the condenser outlet portion may be the condenser subcooling portion 123 and the first inlet passage portion 13*c*

For example, the condenser outlet portion may be the condenser subcooling portion 123, the condenser outlet pipe 32, and the first inlet passage portion 13*c*

Fourth Embodiment

Figure 13:
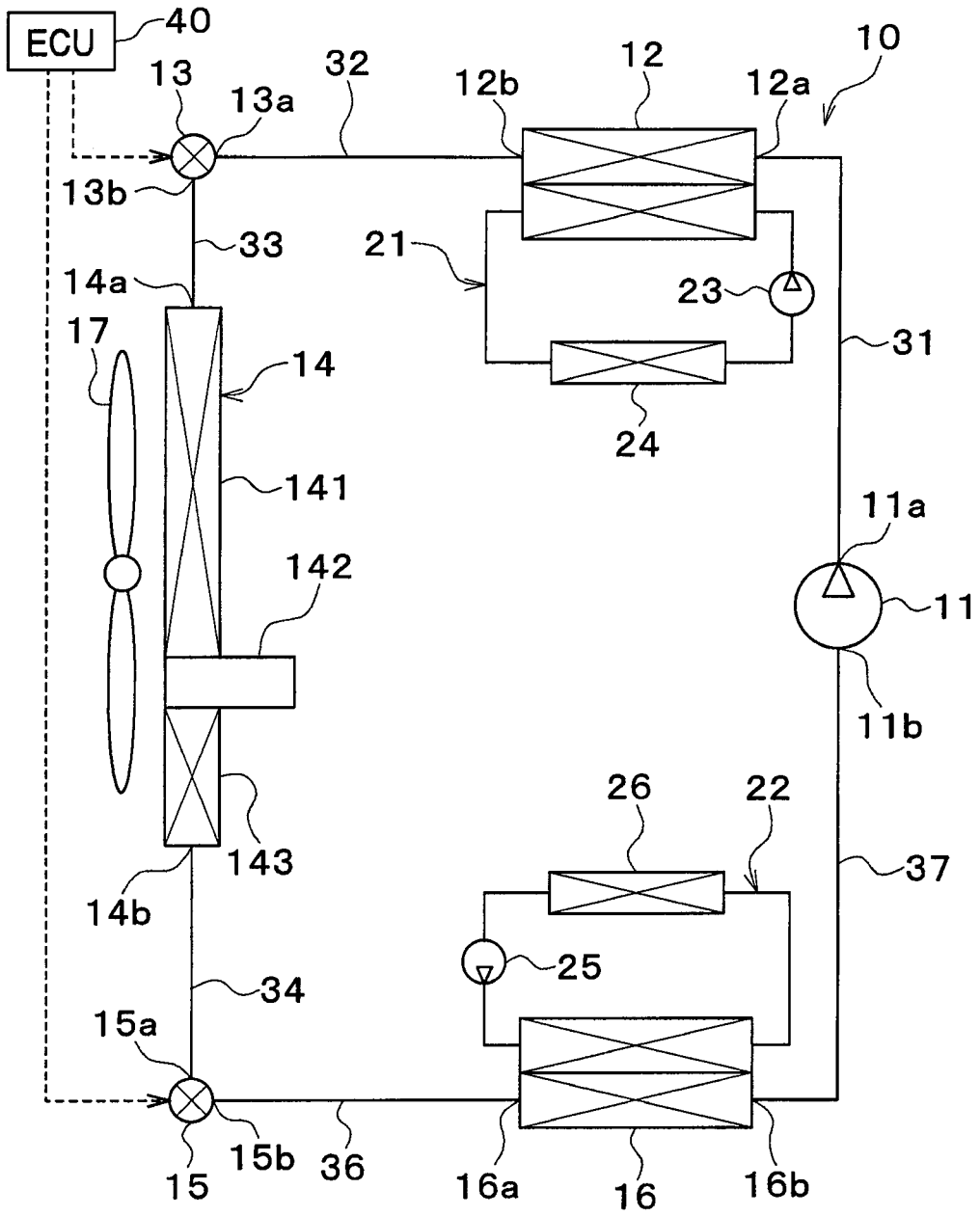
FIG. 13 is a diagram schematically illustrating an overall configuration of a refrigeration cycle device of at least one embodiment of the present disclosure.
Figure 14:
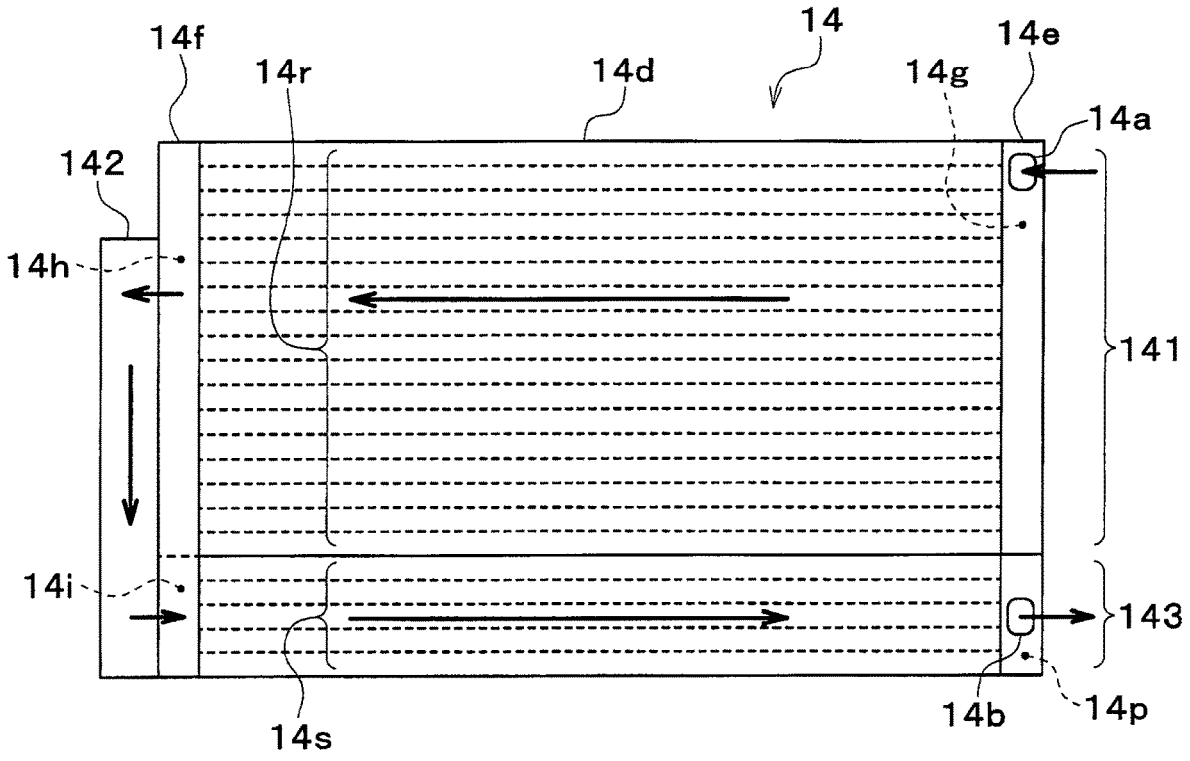
FIG. 14 is a front view illustrating an outside heat exchanger according to at least one embodiment.

In the present embodiment, the subcooling portion bypass pipe 35 is not provided as shown in FIG. 13. Accordingly, the outside heat exchanger 14 does not include the second refrigerant outlet 14*c* as shown in FIG. 14.

In the present embodiment also, as in the above-described first embodiment, a difference in an appropriate refrigerant amount between the cooling mode and the heating mode can be small by appropriately setting volume capacities of the condenser outlet portion, the outside heat exchanger inlet portion, and the outside heat exchanger outlet portion, and accordingly the preferable coefficient of performance of cycle can be achieved in both the cooling mode and the heating mode.

Fifth Embodiment

Figure 15:
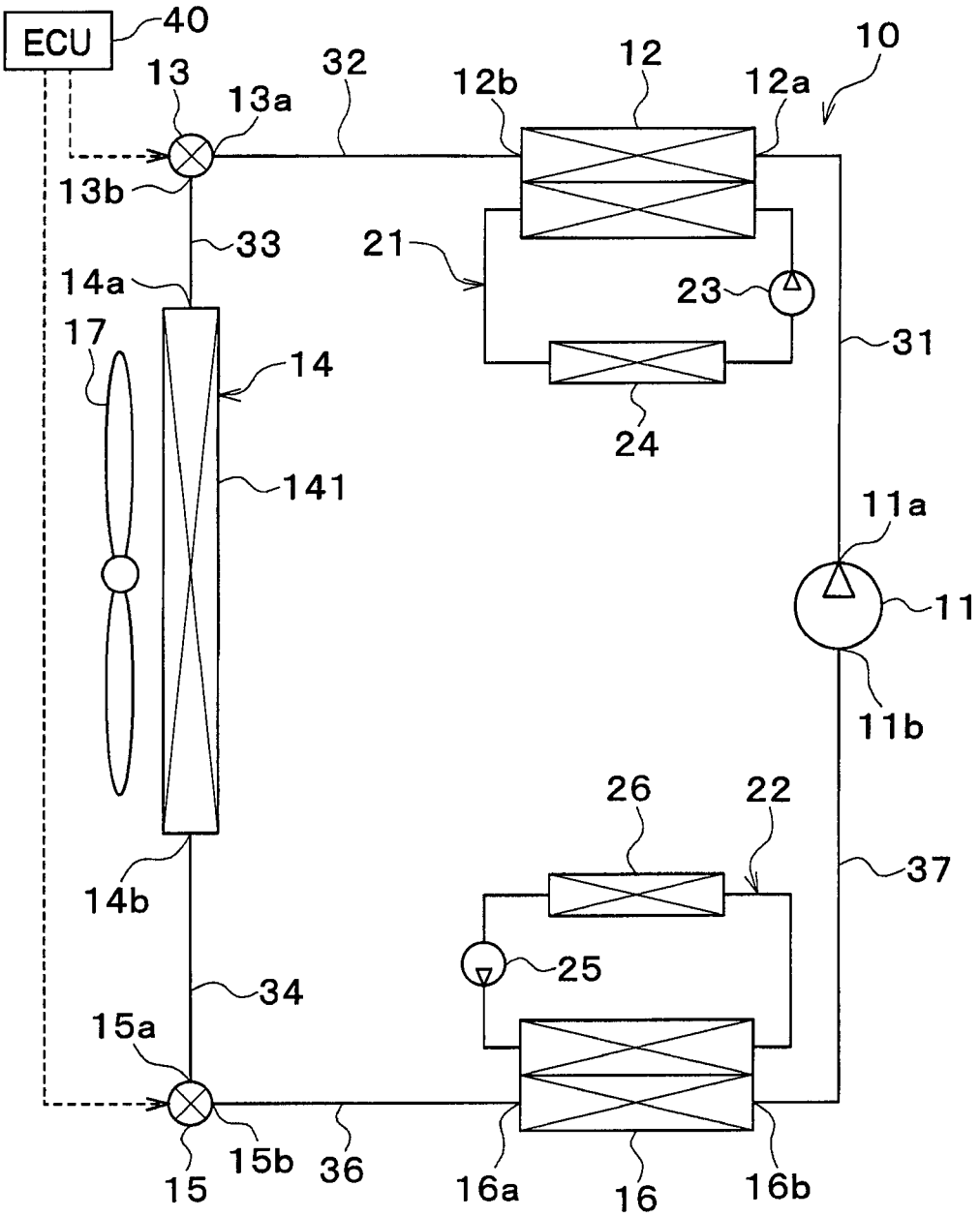
FIG. 15 is a diagram schematically illustrating an overall configuration of a refrigeration cycle device of at least one embodiment of the present disclosure.

In the present embodiment, the outside heat exchanger 14 does not include the outside heat exchanger liquid reservoir 142 and the outside heat exchanger subcooling portion 143, as shown in FIG. 15. An outside heat exchanger outlet pipe 34 is between the refrigerant outlet 14*b* of the outside heat exchanger 14 and the refrigerant inlet 15*a* of the second expansion valve 15.

Figure 16:
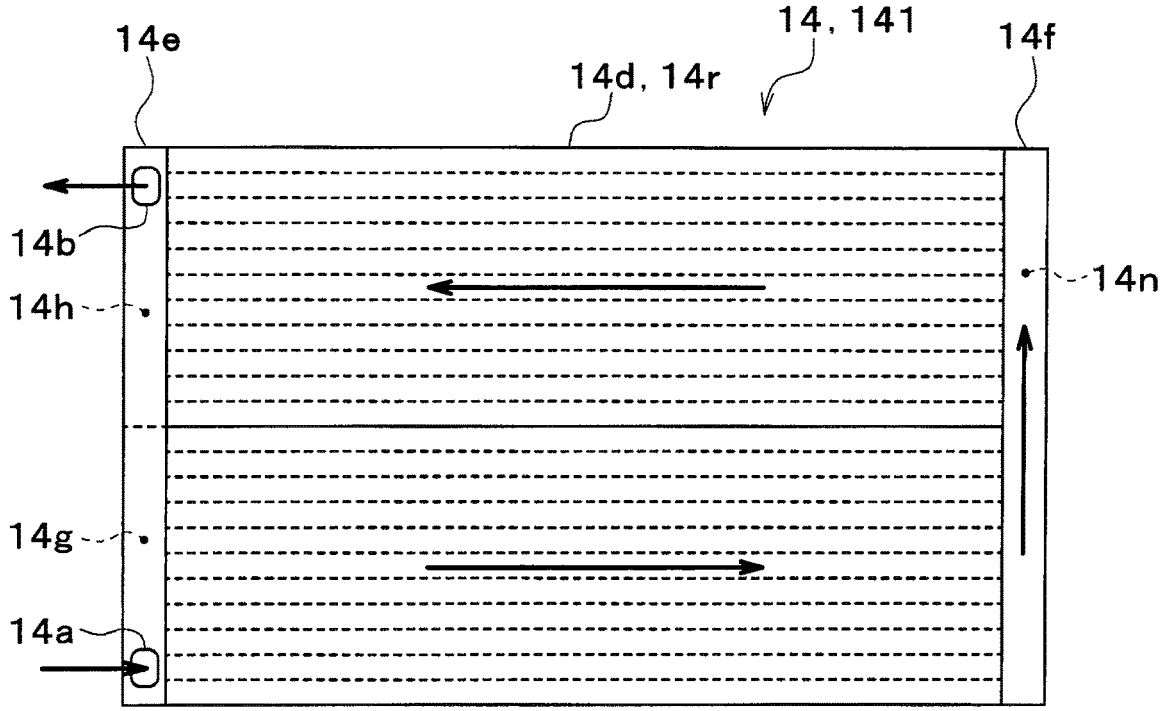
FIG. 16 is a front view illustrating a crossflow-type outside heat exchanger according to at least one embodiment.
Figure 17:
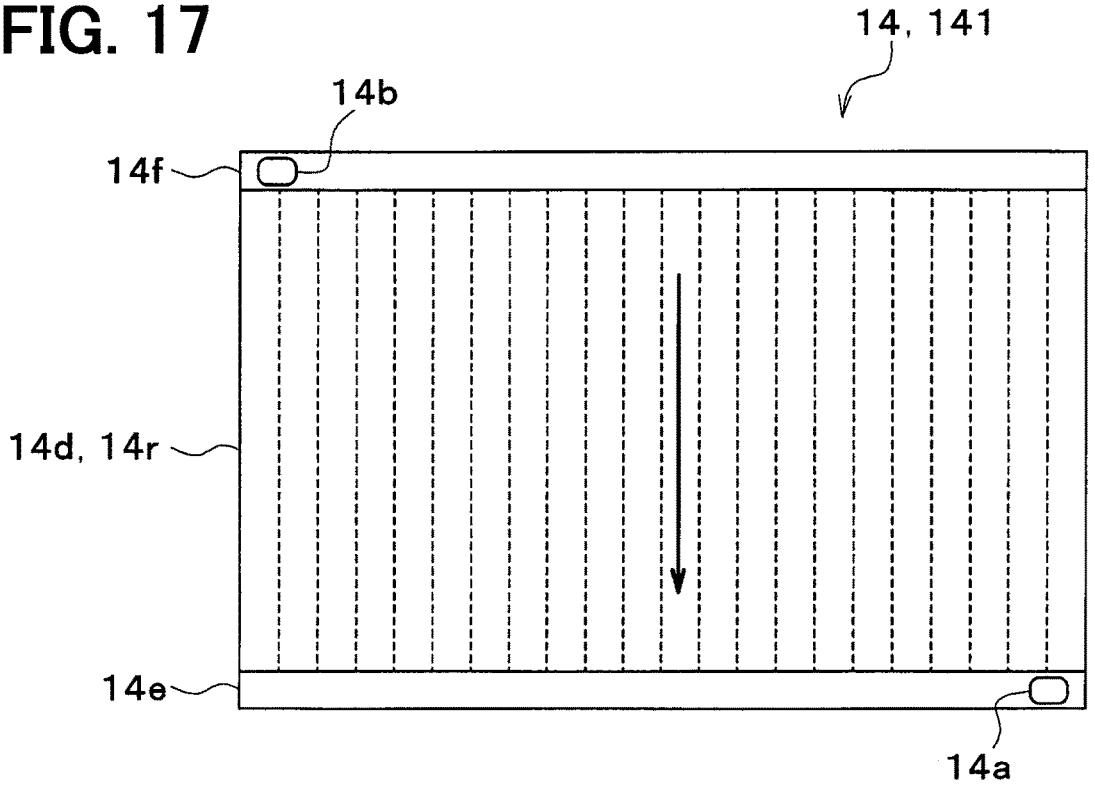
FIG. 17 is a front view illustrating a downflow-type outside heat exchanger according to at least one embodiment.

For example, the outside heat exchanger 14 is a cross-flow-type heat exchanger as shown in FIG. 16. For example, the outside heat exchanger 14 may be a downflow-type heat exchanger as shown in FIG. 17.

In the present embodiment also, as in the above-described embodiments, a difference in an appropriate refrigerant amount between the cooling mode and the heating mode can be small by appropriately setting volume capacities of the condenser outlet portion, the outside heat exchanger inlet portion, and the outside heat exchanger outlet portion. Accordingly, the preferable coefficient of performance of cycle can be achieved in both the cooling mode and the heating mode.

Sixth Embodiment

Figure 18:
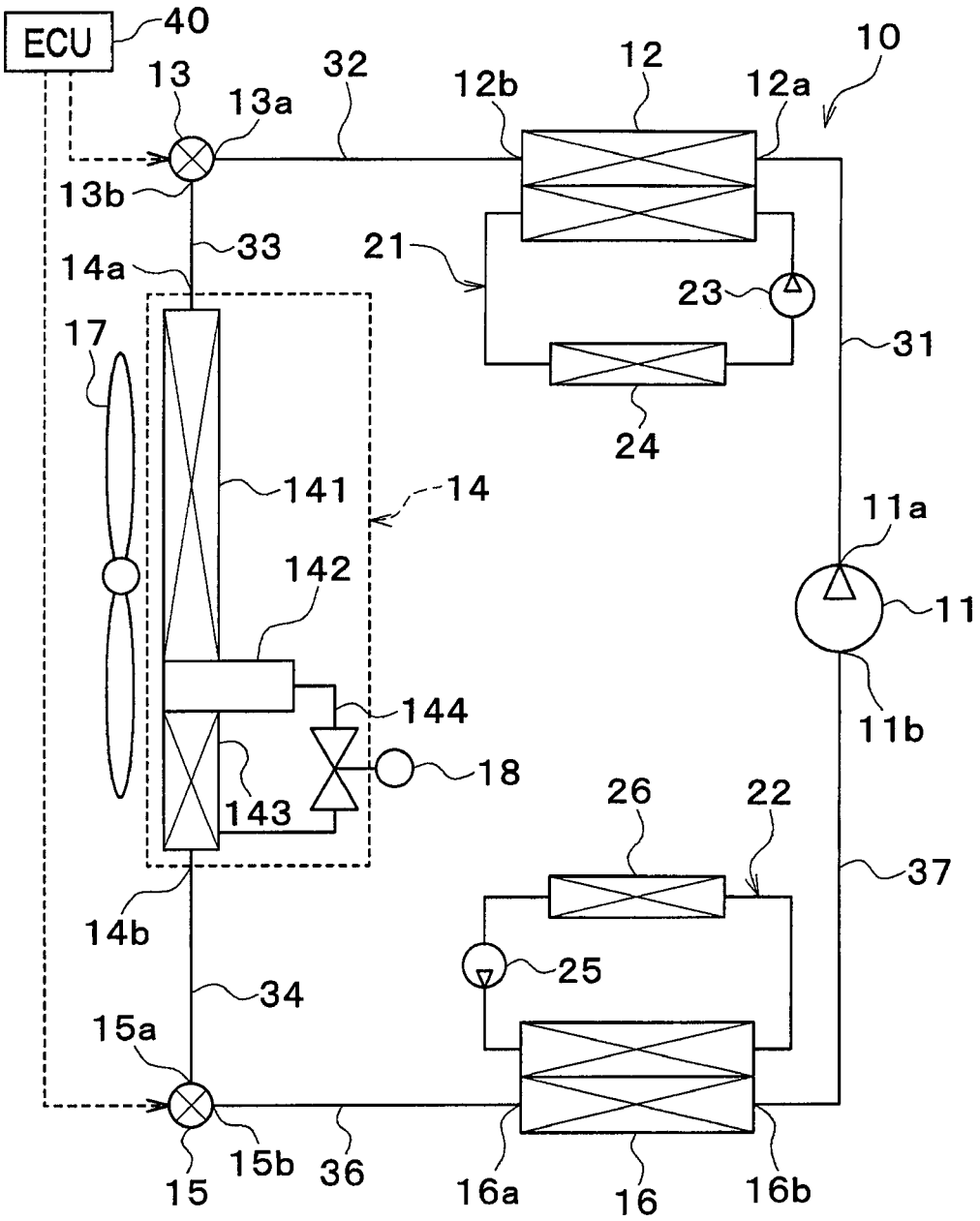
FIG. 18 is a diagram schematically illustrating an overall configuration of a refrigeration cycle device of at least one embodiment of the present disclosure.
Figure 19:
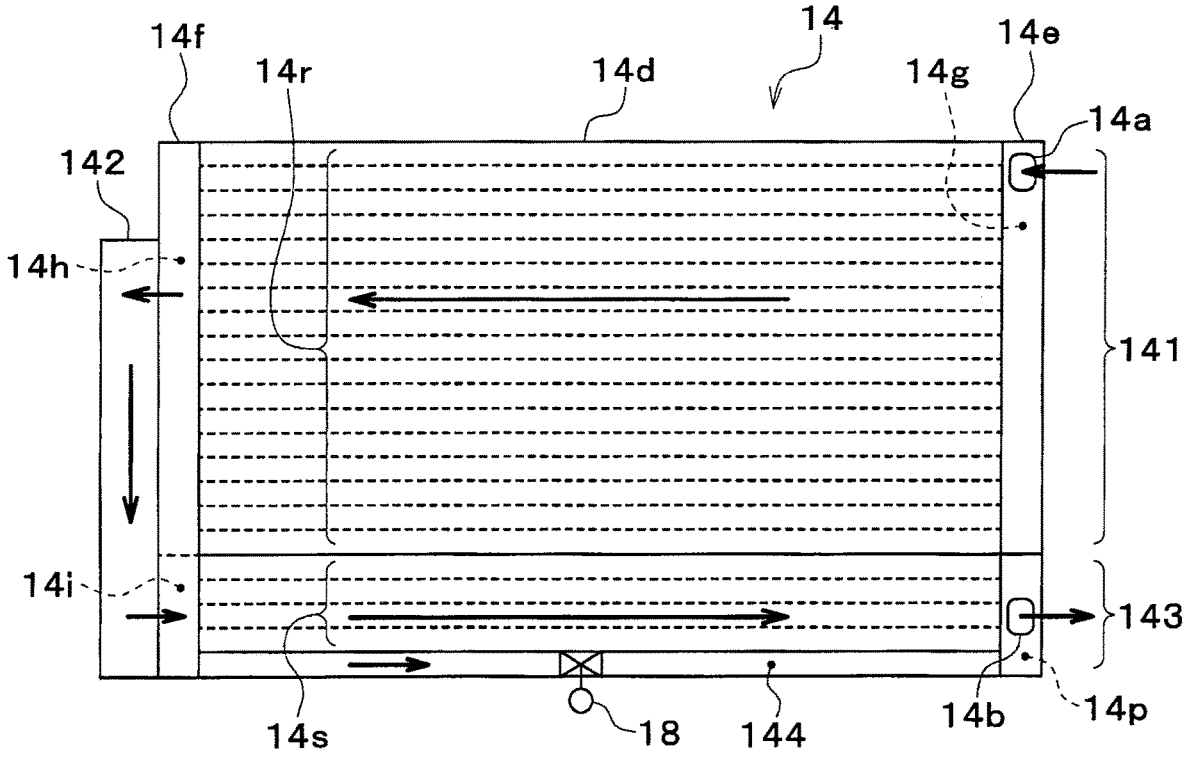
FIG. 19 is a front view illustrating an outside heat exchanger according to at least one embodiment.

Although the subcooling portion bypass pipe 35 is connected to the outside heat exchanger 14 in the above-described embodiments, in the present embodiment, a subcooling bypass portion 144 is provided in the outside heat exchanger 14 as shown in FIGS. 18, 19.

The subcooling bypass portion 144 is a bypass portion through which the refrigerant flowing through the outside heat exchanger liquid reservoir 142 of the outside heat exchanger 14 bypasses the outside heat exchanger subcooling portion 143.

The subcooling bypass on-off valve 18 is provided in the subcooling bypass portion 144. The subcooling bypass on-off valve 18 is configured to adjust the opening degree of the passage in the subcooling bypass portion 144.

An outside heat exchanger outlet pipe 34 is between the refrigerant outlet 14*b* of the outside heat exchanger 14 and the refrigerant inlet 15*a* of the second expansion valve 15.

In the present embodiment also, as in the above-described embodiments, a difference in an appropriate refrigerant amount between the cooling mode and the heating mode can be small by appropriately setting volume capacities of the condenser outlet portion, the outside heat exchanger inlet portion, and the outside heat exchanger outlet portion. Accordingly, the preferable coefficient of performance of cycle can be achieved in both the cooling mode and the heating mode.

For example, the outside heat exchanger outlet portion may be the subcooling bypass portion 144 and the outside heat exchanger outlet pipe 34.

For example, the outside heat exchanger outlet portion may be the subcooling bypass portion 144, the outside heat exchanger outlet pipe 34, and the second inlet passage portion 15*c*.

For example, the outside heat exchanger outlet portion may be the subcooling portion inlet tank portion 14*i*, the subcooling bypass portion 144, the subcooling portion outlet tank portion 14*p*, the outside heat exchanger outlet pipe 34, and the second inlet passage portion 15*c*.

For example, the outside heat exchanger outlet portion may be the heat exchange portion outlet tank portion 14*h*, the subcooling portion inlet tank portion 14*i*, the subcooling core portion 14*s*, the subcooling bypass portion 144, the subcooling portion outlet tank portion 14*p*, the outside heat exchanger outlet pipe 34, and the second inlet passage portion 15*c*.

For example, the outside heat exchanger outlet portion may be the outside heat exchanger subcooling portion 143, the subcooling bypass portion 144, the outside heat exchanger outlet pipe 34, and the second inlet passage portion 15*c*.

For example, the outside heat exchanger outlet portion may be the heat exchange portion outlet tank portion 14*h*, the outside heat exchanger liquid reservoir 142, the subcooling portion inlet tank portion 14*i*, the subcooling core portion 14*s*, the subcooling bypass portion 144, the subcooling portion outlet tank portion 14*p*, the outside heat exchanger outlet pipe 34, and the second inlet passage portion 15*c*.

For example, the outside heat exchanger outlet portion may be the outside heat exchanger liquid reservoir 142, the outside heat exchanger subcooling portion 143, the subcooling bypass portion 144, the outside heat exchanger outlet pipe 34, and the second inlet passage portion 15*c*.

Seventh Embodiment

Figure 20:
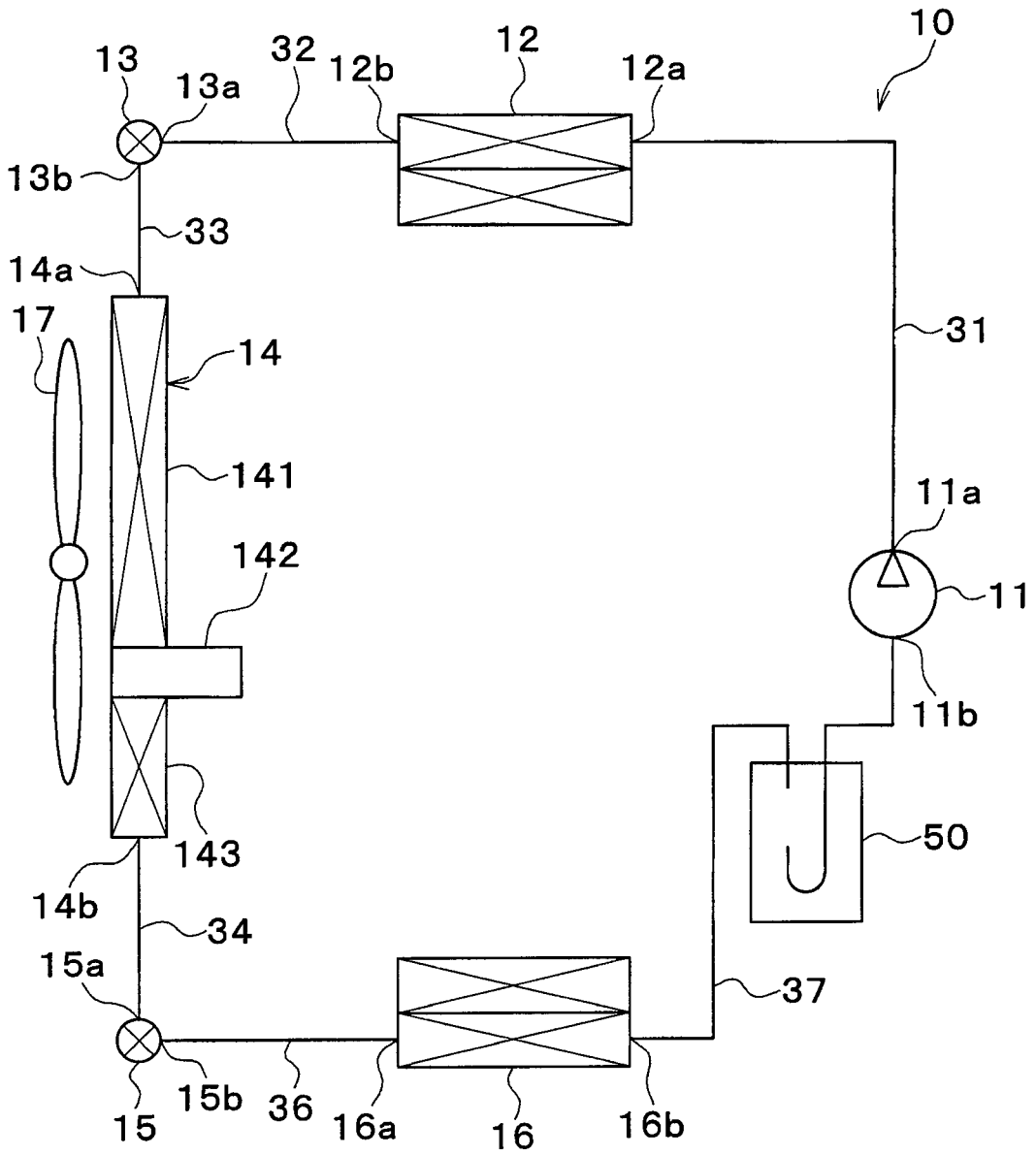
FIG. 20 is a diagram schematically illustrating an overall configuration of a refrigeration cycle device of at least one embodiment of the present disclosure.
Figure 21:
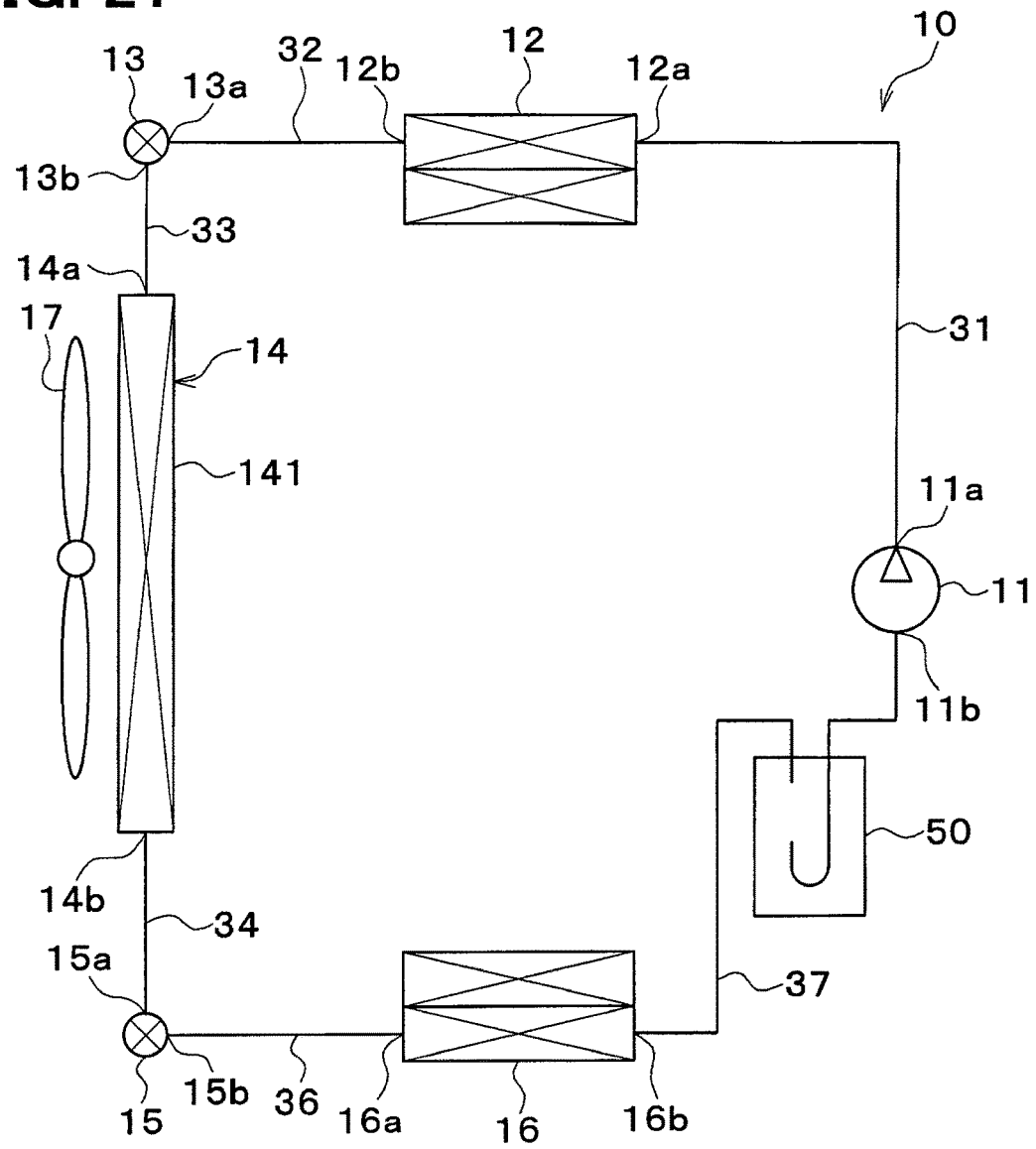
FIG. 21 is a diagram schematically illustrating an overall configuration of a refrigeration cycle device of at least one embodiment.

As shown in FIGS. 20, 21, an accumulator 50 may be provided in the evaporator outlet pipe 37 between the evaporator 16 and the compressor 11.

The accumulator 50 is a gas-liquid separator configured to separate the refrigerant flowing out of the evaporator 16 into gas refrigerant and liquid refrigerant and to store the excess refrigerant. The refrigerant intake port 11*b* of the compressor 11 is connected to an outlet for the gas-phase refrigerant of the accumulator 50. The accumulator 50 limits liquid-phase refrigerant from being drawn into the compressor 11 to avoid liquid compression of the compressor 11.

In a first example shown in FIG. 20, the accumulator 50 is added to the configuration of the fourth embodiment. In a second example shown in FIG. 21, the accumulator 50 is added to the configuration of the fifth embodiment. The accumulator 50 may be added to the configuration of the first, second, third, or sixth embodiment.

In the present embodiment also, as in the above-described embodiments, a difference in an appropriate refrigerant amount between the cooling mode and the heating mode can be small by appropriately setting volume capacities of the condenser outlet portion, the outside heat exchanger inlet portion, and the outside heat exchanger outlet portion, and accordingly the preferable coefficient of performance of cycle can be achieved in both the cooling mode and the heating mode. In addition, the accumulator 50 can be downsized.

Eighth Embodiment

In the above described embodiments, the first expansion valve 13 and the second expansion valve 15 are variable throttles that fully open the refrigerant passage when the throttle opening degree is in fully open state. In the present embodiment, variable throttles that do not fully open the throttle opening degree are used as the first expansion valve 13 and the second expansion valve 15.

Figure 22:
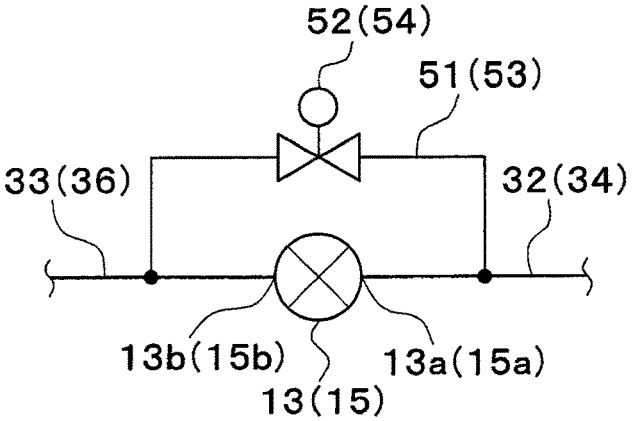
FIG. 22 is a diagram showing a vicinity of a first expansion valve of a refrigeration cycle device according to at least one embodiment of the present disclosure.

As shown in FIG. 22, the refrigeration cycle device 10 includes a first expansion valve bypass pipe 51, a first bypass on-off valve 52, a second expansion valve bypass pipe 53, and a second bypass on-off valve 54.

The basic structures of the second expansion valve bypass pipe 53 and the second bypass on-off valve 54 are the same as the first expansion valve bypass pipe 51 and the first bypass on-off valve 52, respectively. Accordingly, the first expansion valve bypass pipe 51 and the first bypass on-off valve 52 are shown in FIG. 22. The reference numerals corresponding to the second expansion valve bypass pipe 53 and the second bypass on-off valve 54 are described in parentheses in FIG. 22, and the illustration of the second expansion valve bypass pipe 53 and the second bypass on-off valve 54 are omitted.

The first expansion valve bypass pipe 51 defines the refrigerant passage through which the refrigerant bypasses the first expansion valve 13. The first bypass on-off valve 52 opens and closes the refrigerant passage in the first expansion valve bypass pipe 51. An operation of the first bypass on-off valve 52 is controlled by a control signal output from the controller 40.

When the first bypass on-off valve 52 opens the refrigerant passage in the first expansion valve bypass pipe 51, the refrigerant flows through the refrigerant passage in the first expansion valve bypass pipe 51, and the refrigerant does not pass through the first expansion valve 13. Accordingly, it is possible to prevent the first expansion valve 13 from exerting the decompression action of the refrigerant.

The second expansion valve bypass pipe 53 defines the refrigerant passage through which the refrigerant bypasses the second expansion valve 15. The second bypass on-off valve 54 opens and closes the refrigerant passage in the second expansion valve bypass pipe 53. An operation of the second bypass on-off valve 54 is controlled by a control signal output from the controller 40.

When the second bypass on-off valve 54 opens the refrigerant passage in the second expansion valve bypass pipe 53, the refrigerant flows through the refrigerant passage in the second expansion valve bypass pipe 53, and the refrigerant does not pass through the second expansion valve 15. Accordingly, it is possible to prevent the second expansion valve 15 from exerting the decompression action of the refrigerant.

The first expansion valve bypass pipe 51, the first bypass on-off valve 52, the second expansion valve bypass pipe 53, and the second bypass on-off valve 54 are operation mode switching portions configured to switch between the cooling mode and the heating mode.

In the present embodiment also, as in the above-described embodiments, a difference in an appropriate refrigerant amount between the cooling mode and the heating mode can be small by appropriately setting volume capacities of the condenser outlet portion, the outside heat exchanger inlet portion, and the outside heat exchanger outlet portion. Accordingly, the preferable coefficient of performance of cycle can be achieved in both the cooling mode and the heating mode.

The first expansion valve 13 and the second expansion valve 15 may be a fixed throttle or a thermal expansion valve which cannot fully open the throttle opening degree.

The fixed throttle is an orifice, a capillary tube, or the like. The thermal expansion valve is an expansion valve having a temperature sensitive passage and a mechanism for adjusting the throttle passage area. The mechanism of the thermal expansion valve is configured to adjust the throttle passage area such that the superheat degree of the refrigerant flowing through the temperature sensitive passage is within a predetermined range.

Ninth Embodiment

In the present embodiment, an evaporator bypass pipe 38 is provided as shown in FIGS. 23 to 35. The evaporator bypass passage 38 defines a bypass passage through which the refrigerant flowing out of the outside heat exchanger 14 bypasses the second expansion valve 15 and the evaporator 16 and flows to the intake side of the compressor 11. An evaporator bypass on-off valve 39 is provided in the evaporator bypass pipe 38. The evaporator bypass on-off valve 39 is an on-off valve configured to open and close the bypass passage of the evaporator bypass passage 38.

Figure 23:
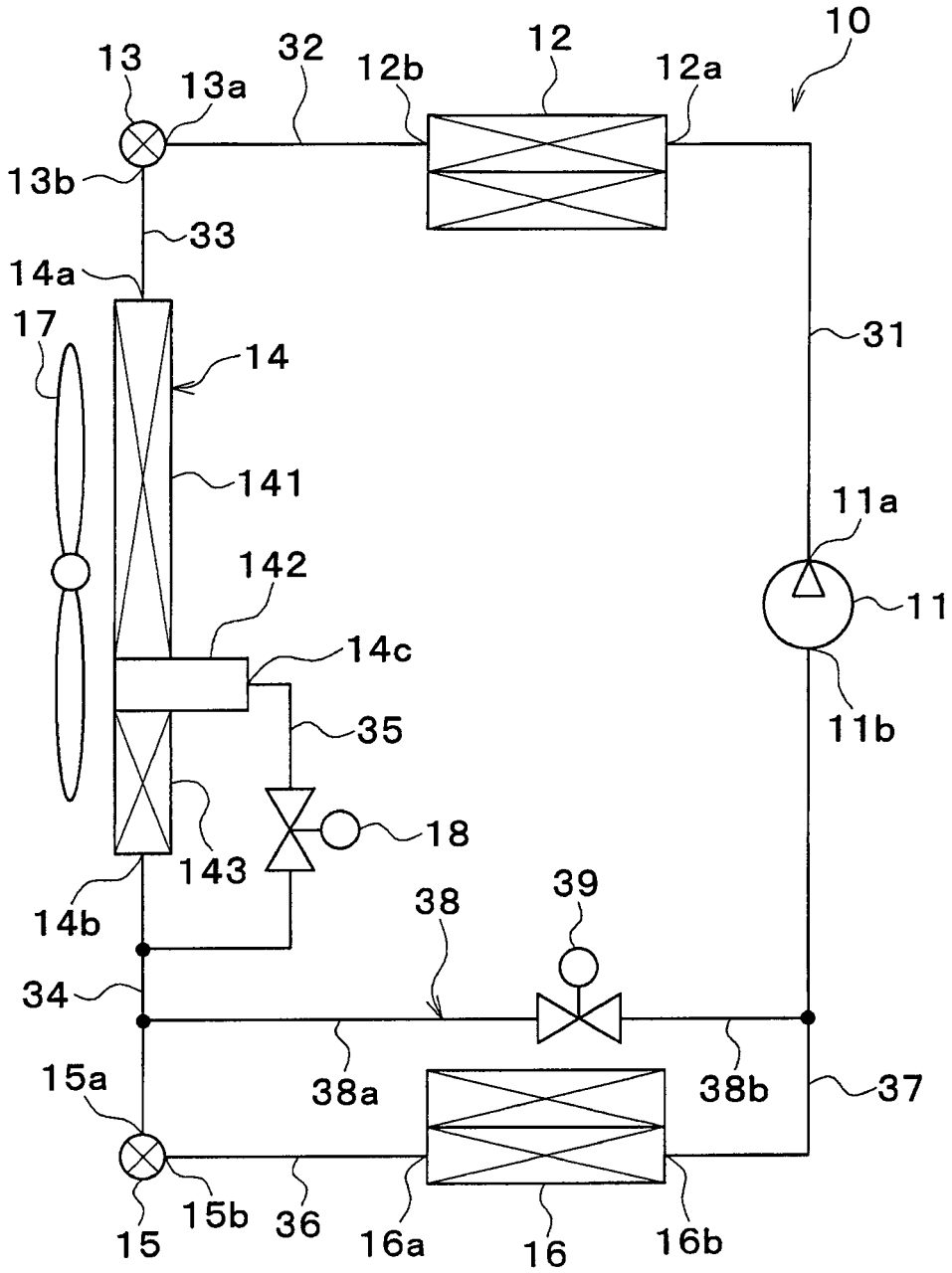
FIG. 23 is a diagram schematically illustrating an overall configuration of a refrigeration cycle device of at least one embodiment of the present disclosure.

In a first example shown in FIG. 23, the evaporator bypass pipe 38 and the evaporator bypass on-off valve 39 are added to the first embodiment. One end of the evaporator bypass pipe 38 is connected to a part of the subcooling portion outlet pipe 34 between a joint with the subcooling portion bypass pipe 35 and the refrigerant inlet 15*a* of the second expansion valve 15. The other end of the evaporator bypass pipe 38 is connected to the evaporator outlet pipe 37.

Hereinafter, a part of the evaporator bypass pipe 38 located upstream of the evaporator bypass on-off valve 39 with respect to the refrigerant flow is referred to as a bypass pipe inlet portion 38*a*, and a part of the evaporator bypass pipe 38 located downstream of the evaporator bypass on-off valve 39 with respect to the refrigerant flow is referred to as a bypass pipe downstream portion 38*b*.

In the present embodiment, the volume capacity of the condenser outlet portion is larger than the total volume capacity of the bypass pipe inlet portion 38*a* and the outside heat exchanger outlet portion.

According to this, since the volume capacity of a part through which the liquid-phase refrigerant flows in the heating mode is large and that in the cooling mode is small compared to a case where the total volume capacity of the bypass pipe inlet portion 38*a* and the condenser outlet portion is at or below the outside heat exchanger outlet portion, the appropriate refrigerant amount in the heating mode increases and that in the cooling mode decreases. As a result, the difference in the appropriate refrigerant amount between the cooling mode and the heating mode can be small, and accordingly the preferable coefficient of performance of cycle can be achieved in both cooling mode and heating mode.

Figure 24:
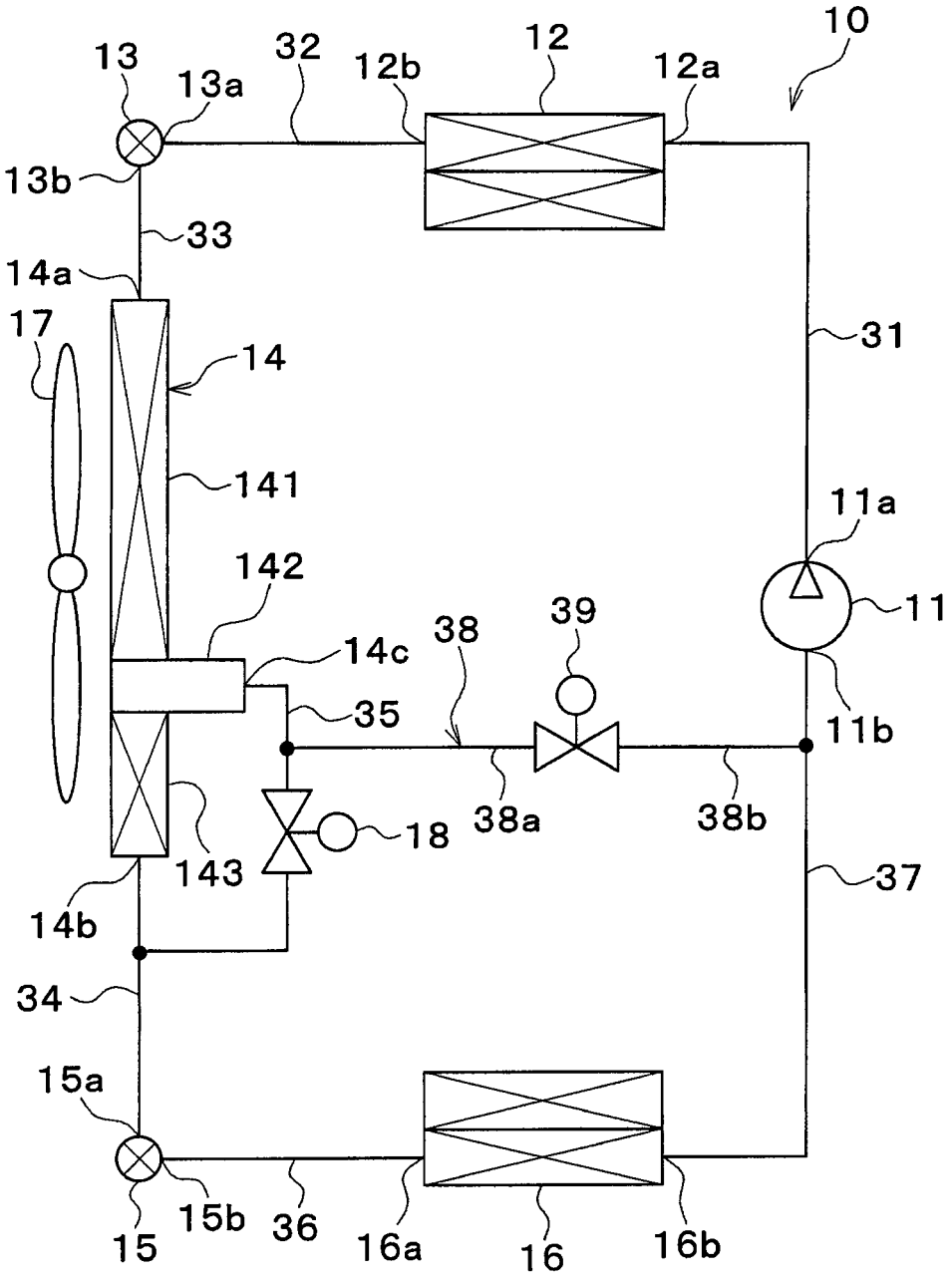
FIG. 24 is a diagram schematically illustrating an overall configuration of a refrigeration cycle device of at least one embodiment.

In a second example shown in FIG. 24, the evaporator bypass pipe 38 and the evaporator bypass on-off valve 39 are added to the first embodiment. One end of the evaporator bypass pipe 38 is connected to a part of the subcooling portion bypass pipe 35 located upstream of the subcooling bypass on-off valve 18 with respect to the refrigerant flow. The other end of the evaporator bypass pipe 38 is connected to the evaporator outlet pipe 37.

Figure 25:
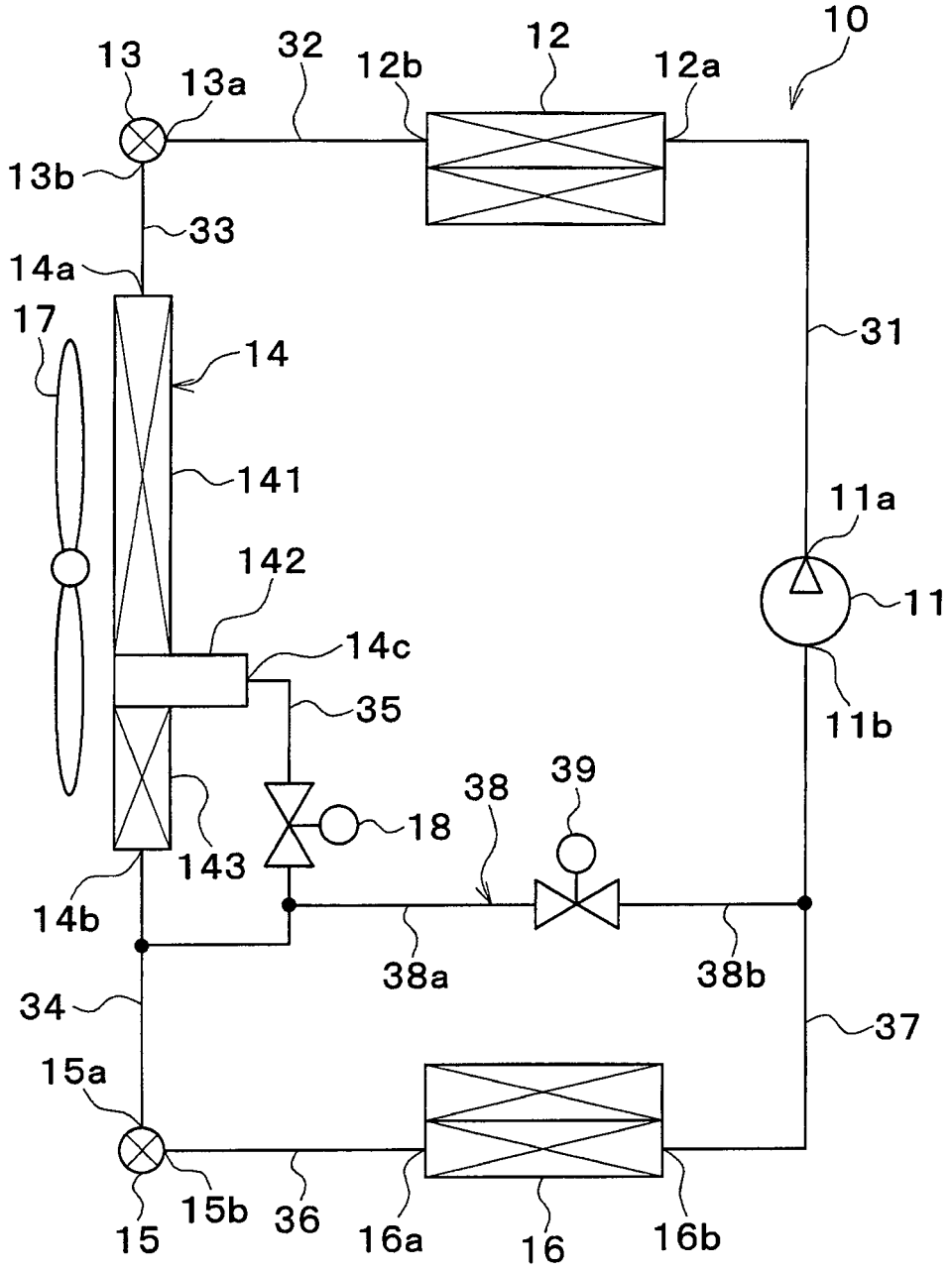
FIG. 25 is a diagram schematically illustrating an overall configuration of a refrigeration cycle device of at least one embodiment.

In a third example shown in FIG. 25, the evaporator bypass pipe 38 and the evaporator bypass on-off valve 39 are added to the first embodiment. One end of the evaporator bypass pipe 38 is connected to a part of the subcooling portion bypass pipe 35 located downstream of the subcooling bypass on-off valve 18 with respect to the refrigerant flow. The other end of the evaporator bypass pipe 38 is connected to the evaporator outlet pipe 37.

Figure 26:
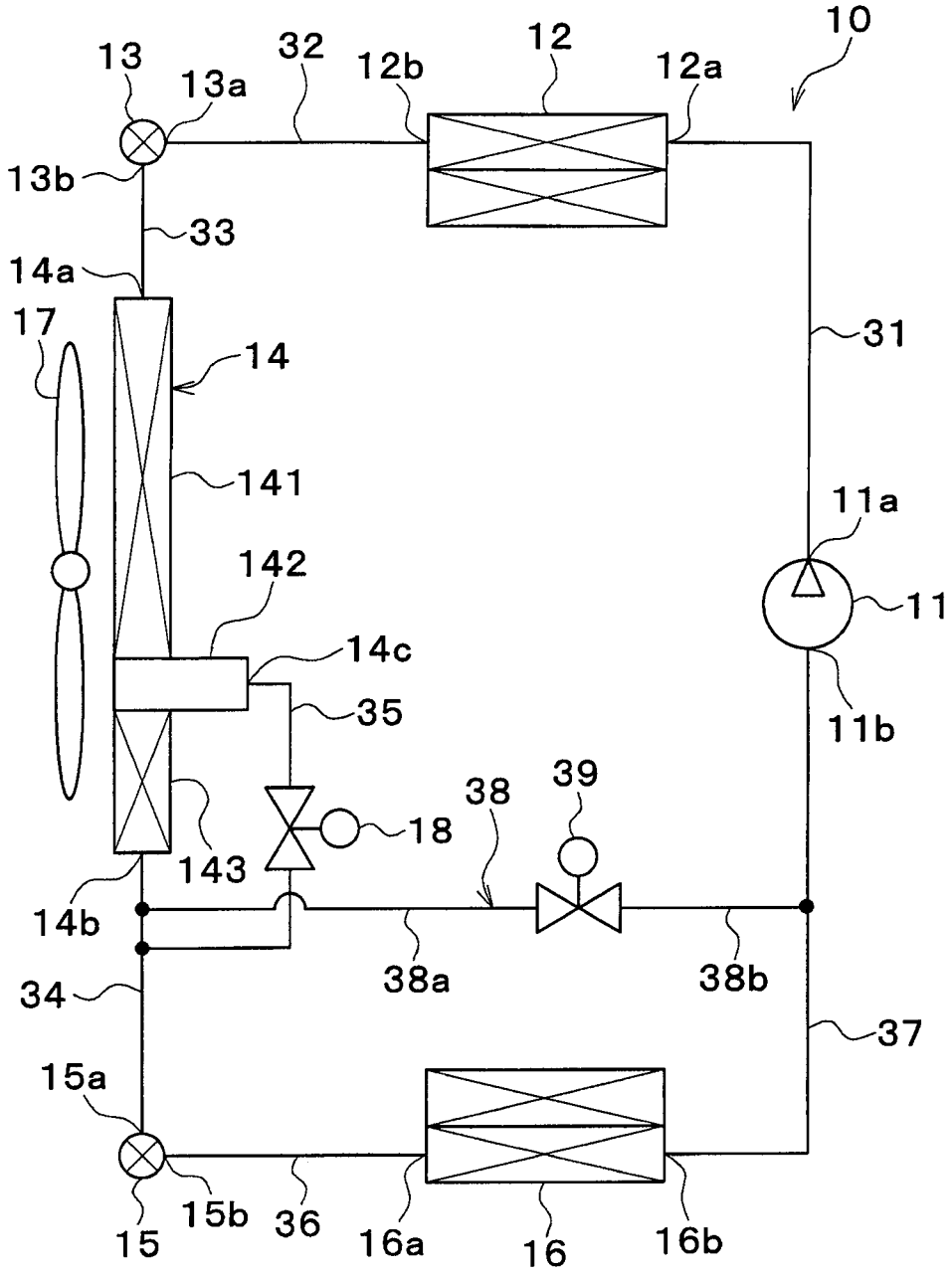
FIG. 26 is a diagram illustrating an overall configuration of a refrigeration cycle device of at least one embodiment.

In a fourth example shown in FIG. 26, the evaporator bypass pipe 38 and the evaporator bypass on-off valve 39 are added to the first embodiment. One end of the evaporator bypass pipe 38 is connected to a part of the subcooling portion outlet pipe 34 between the first refrigerant outlet 14*b* of the outside heat exchanger 14 and a joint with the subcooling bypass pipe 35. The other end of the evaporator bypass pipe 38 is connected to the evaporator outlet pipe 37.

Figure 27:
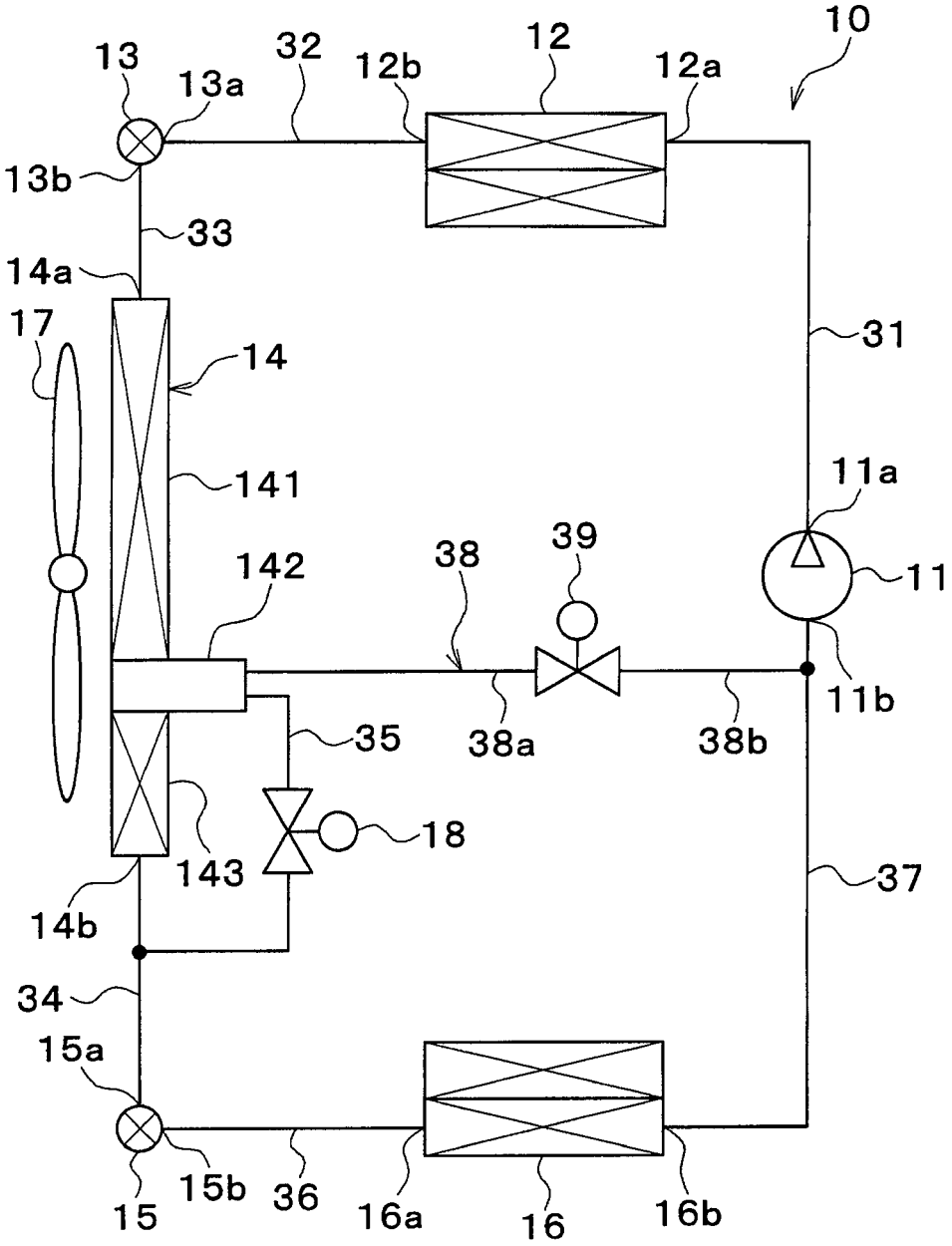
FIG. 27 is a diagram illustrating an overall configuration of a refrigeration cycle device of at least one embodiment.

In a fifth example shown in FIG. 27, the evaporator bypass pipe 38 and the evaporator bypass on-off valve 39 are added to the first embodiment. One end of the evaporator bypass pipe 38 is connected to the outside heat exchanger liquid reservoir 142. The other end of the evaporator bypass pipe 38 is connected to the evaporator outlet pipe 37.

Figure 28:
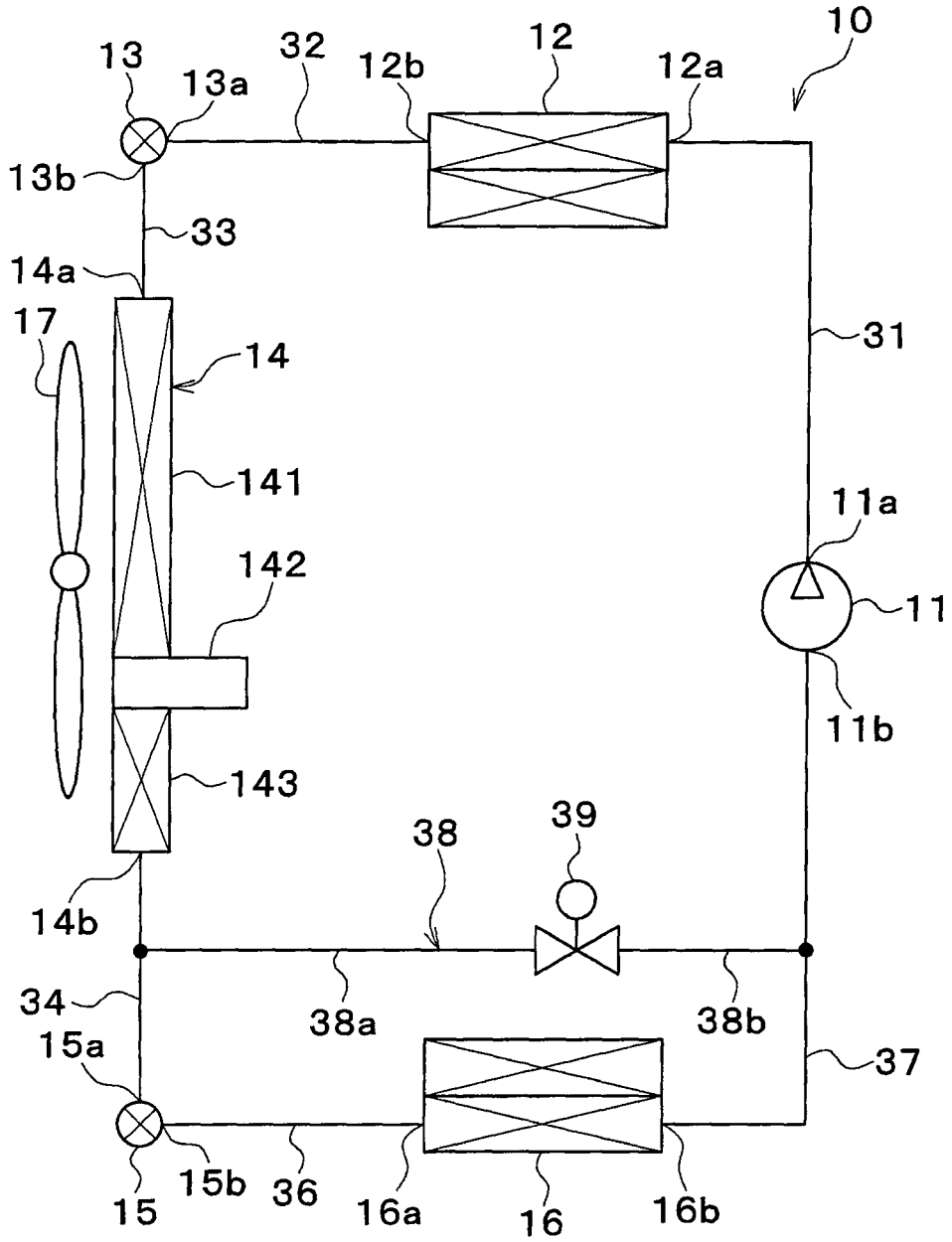
FIG. 28 is a diagram schematically illustrating an overall configuration of a refrigeration cycle device of at least one embodiment.

In a sixth example shown in FIG. 28, the evaporator bypass pipe 38 and the evaporator bypass on-off valve 39 are added to the fourth embodiment. One end of the evaporator bypass pipe 38 is connected to the subcooling portion outlet pipe 34. The other end of the evaporator bypass pipe 38 is connected to the evaporator outlet pipe 37.

Figure 29:
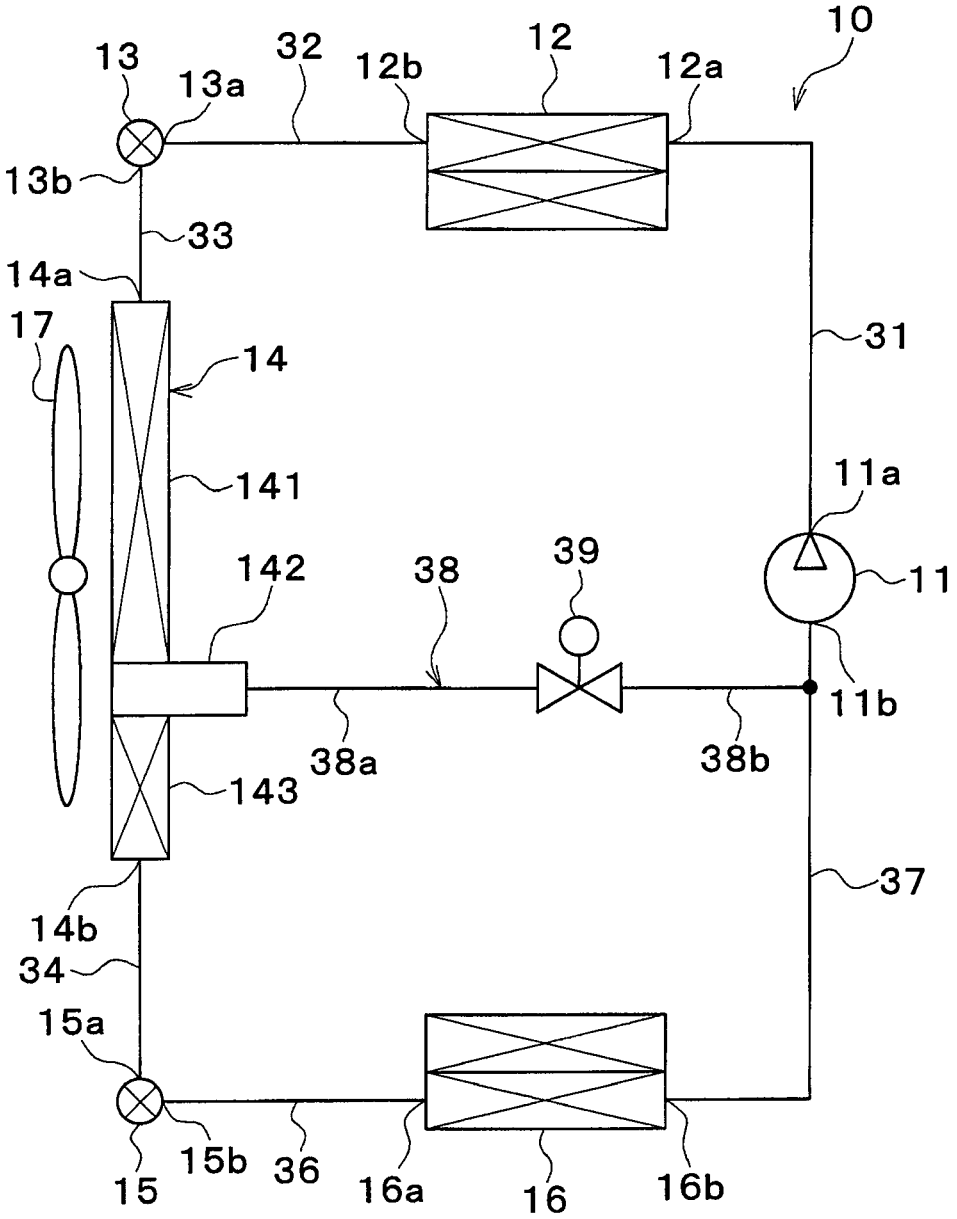
FIG. 29 is a diagram schematically illustrating an overall configuration of a refrigeration cycle device of at least one embodiment.

In a seventh example shown in FIG. 29, the evaporator bypass pipe 38 and the evaporator bypass on-off valve 39 are added to the fourth embodiment. One end of the evaporator bypass pipe 38 is connected to the outside heat exchanger liquid reservoir 142. The other end of the evaporator bypass pipe 38 is connected to the evaporator outlet pipe 37.

Figure 30:
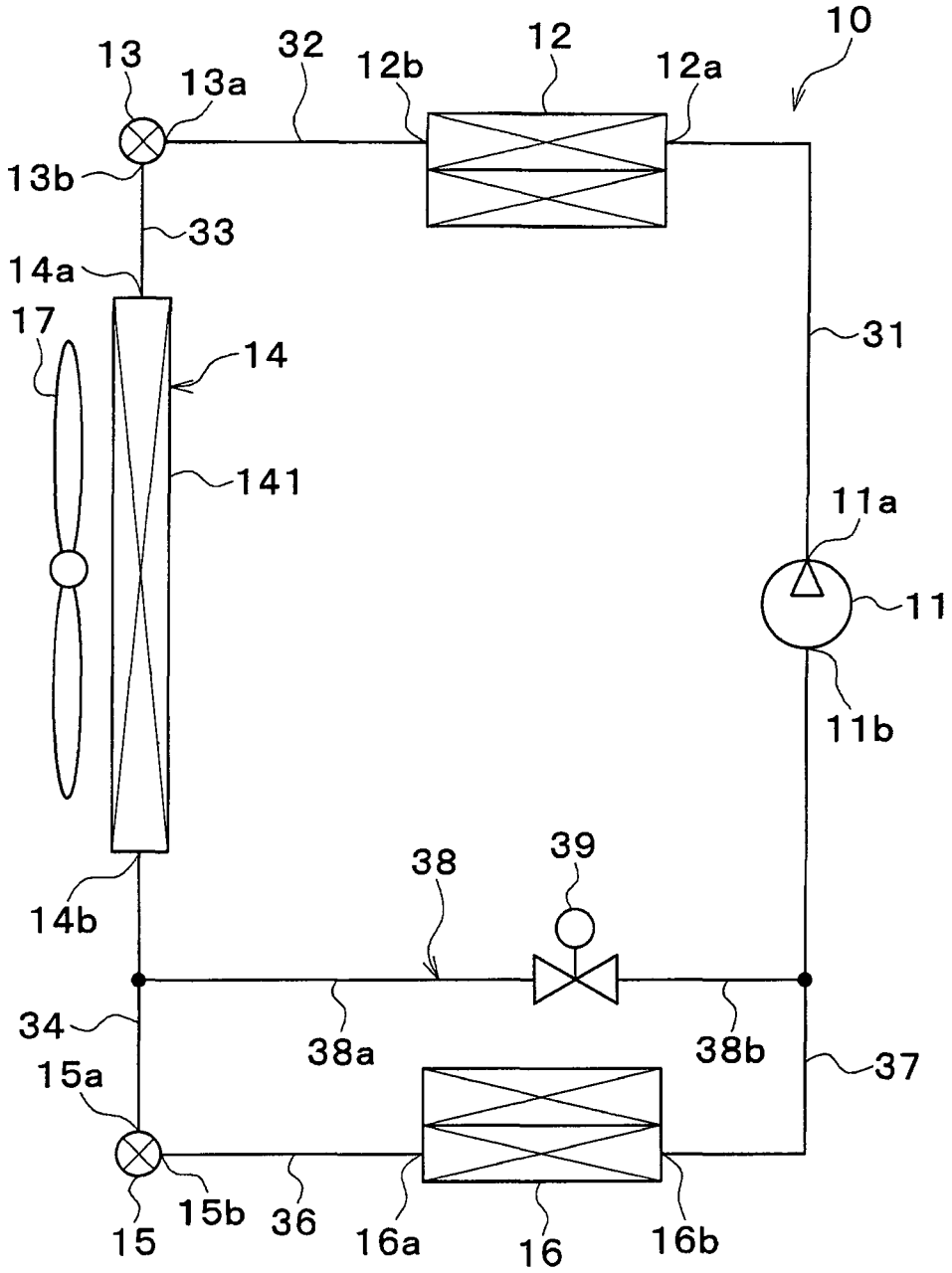
FIG. 30 is a diagram schematically illustrating an overall configuration of a refrigeration cycle device of at least one embodiment.

In an eighth example shown in FIG. 30, the evaporator bypass pipe 38 and the evaporator bypass on-off valve 39 are added to the fifth embodiment. One end of the evaporator bypass pipe 38 is connected to the outside heat exchanger outlet pipe 34. The other end of the evaporator bypass pipe 38 is connected to the evaporator outlet pipe 37.

Figure 31:
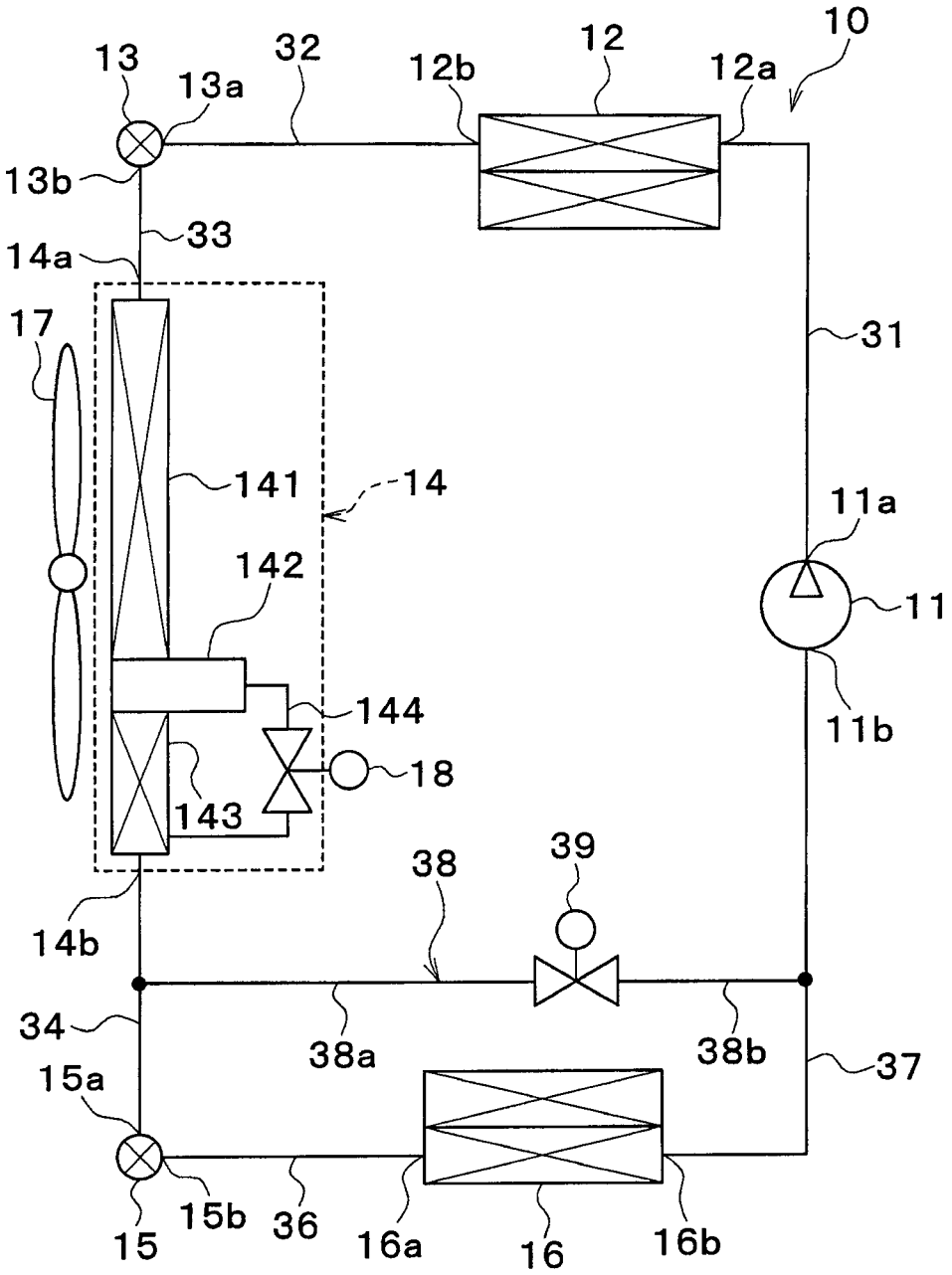
FIG. 31 is a diagram schematically illustrating an overall configuration of a refrigeration cycle device of at least one embodiment.

In a ninth example shown in FIG. 31, the evaporator bypass pipe 38 and the evaporator bypass on-off valve 39 are added to the sixth embodiment. One end of the evaporator bypass pipe 38 is connected to the outside heat exchanger outlet pipe 34. The other end of the evaporator bypass pipe 38 is connected to the evaporator outlet pipe 37.

Figure 32:
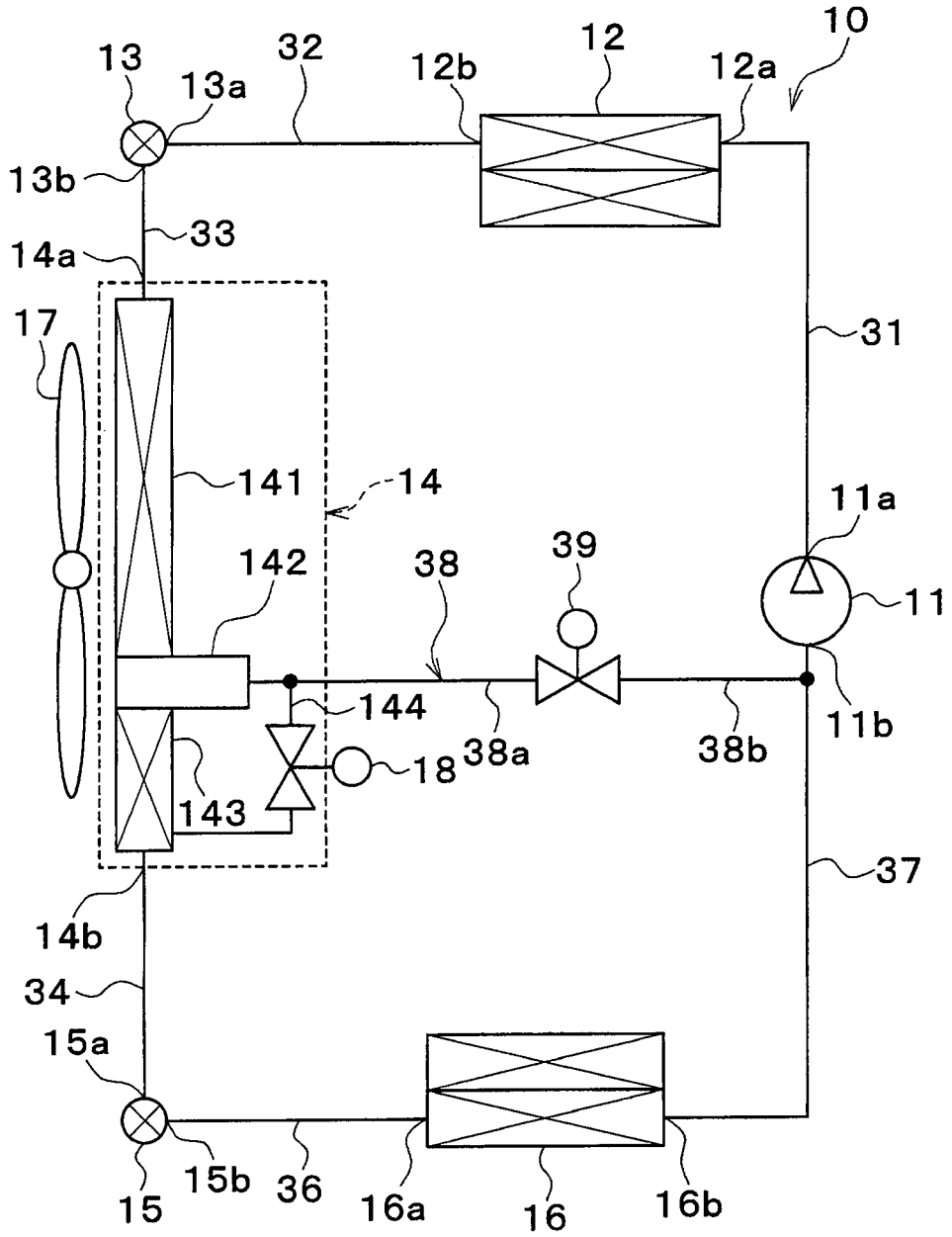
FIG. 32 is a diagram schematically illustrating an overall configuration of a refrigeration cycle device of at least one embodiment.

In a tenth example shown in FIG. 32, the evaporator bypass pipe 38 and the evaporator bypass on-off valve 39 are added to the sixth embodiment. One end of the evaporator bypass pipe 38 is connected to a part of the subcooling portion bypass pipe 35 located upstream of the subcooling bypass on-off valve 18 with respect to the refrigerant flow. The other end of the evaporator bypass pipe 38 is connected to the evaporator outlet pipe 37.

Figure 33:
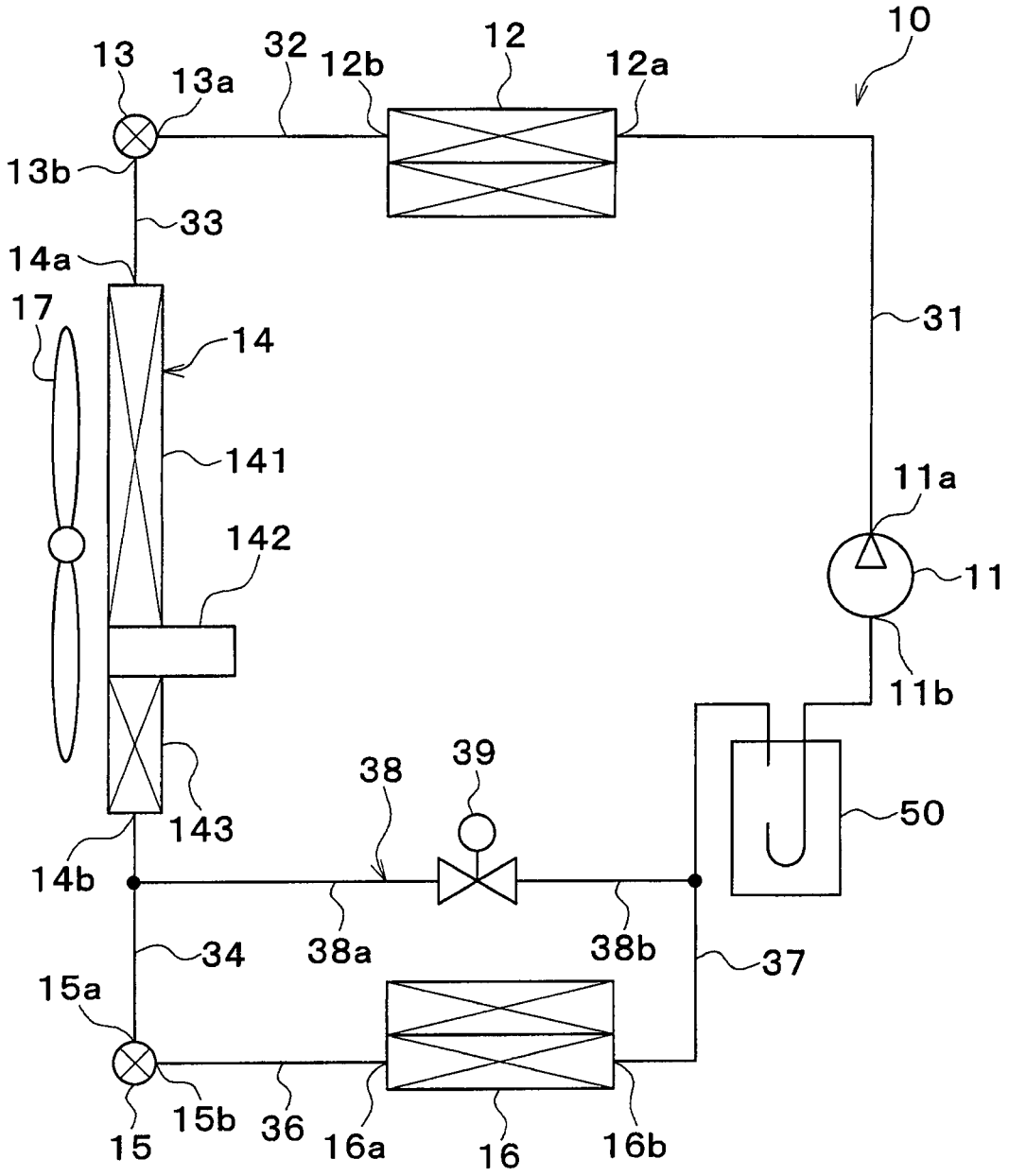
FIG. 33 is a diagram schematically illustrating an overall configuration of a refrigeration cycle device of at least one embodiment.

In an eleventh example shown in FIG. 33, the evaporator bypass pipe 38 and the evaporator bypass on-off valve 39 are added to the first example of the seventh embodiment. One end of the evaporator bypass pipe 38 is connected to the subcooling portion outlet pipe 34. The other end of the evaporator bypass pipe 38 is connected to a part of the evaporator outlet pipe 37 between the accumulator 50 and the refrigerant outlet 16*b* of the evaporator 16.

Figure 34:
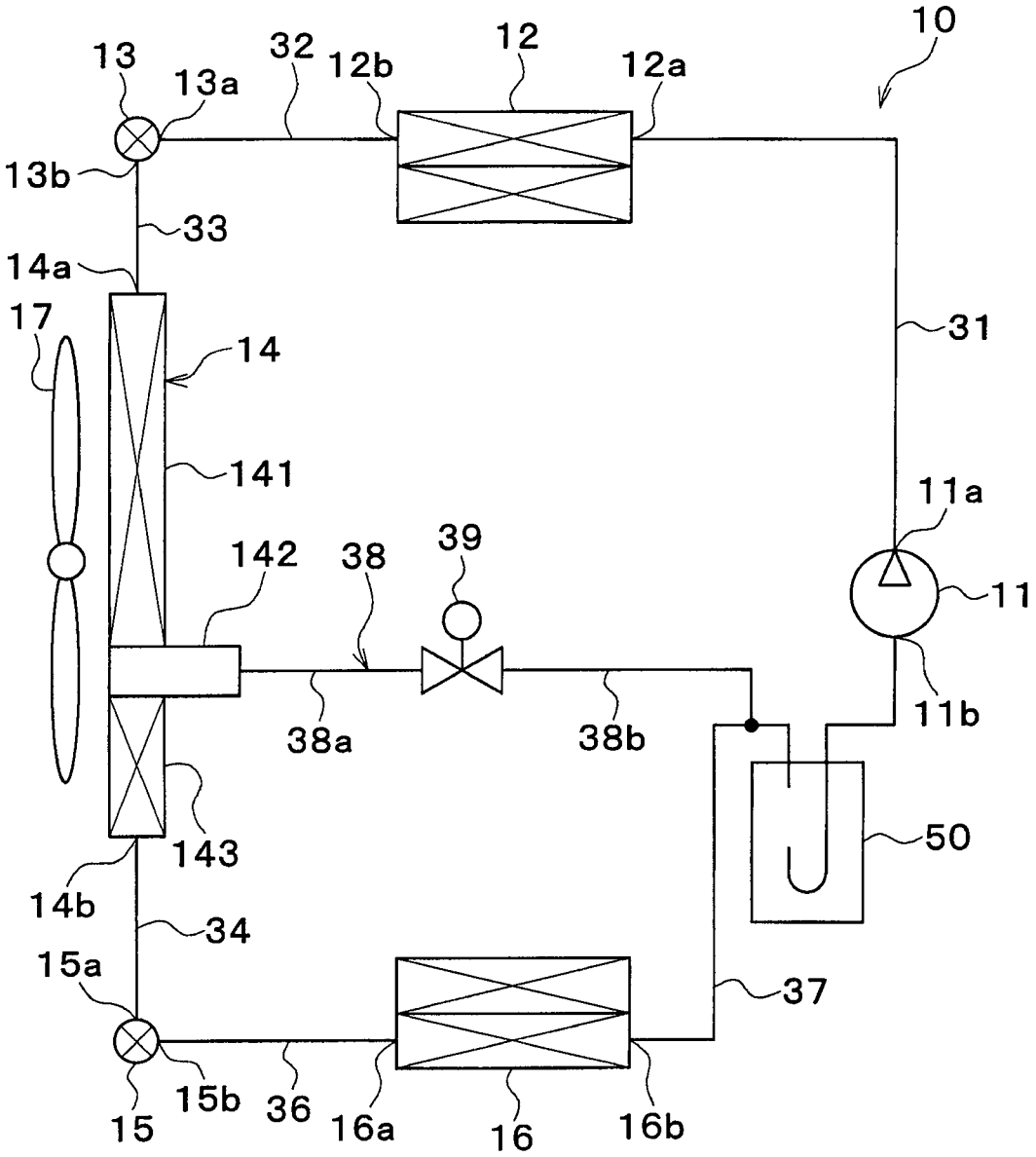
FIG. 34 is a diagram schematically illustrating an overall configuration of a refrigeration cycle device of at least one embodiment.

In a twelfth example shown in FIG. 34, the evaporator bypass pipe 38 and the evaporator bypass on-off valve 39 are added to the first example of the seventh embodiment. One end of the evaporator bypass pipe 38 is connected to the outside heat exchanger liquid reservoir 142. The other end of the evaporator bypass pipe 38 is connected to a part of the evaporator outlet pipe 37 between the accumulator 50 and the refrigerant outlet 16*b* of the evaporator 16.

Figure 35:
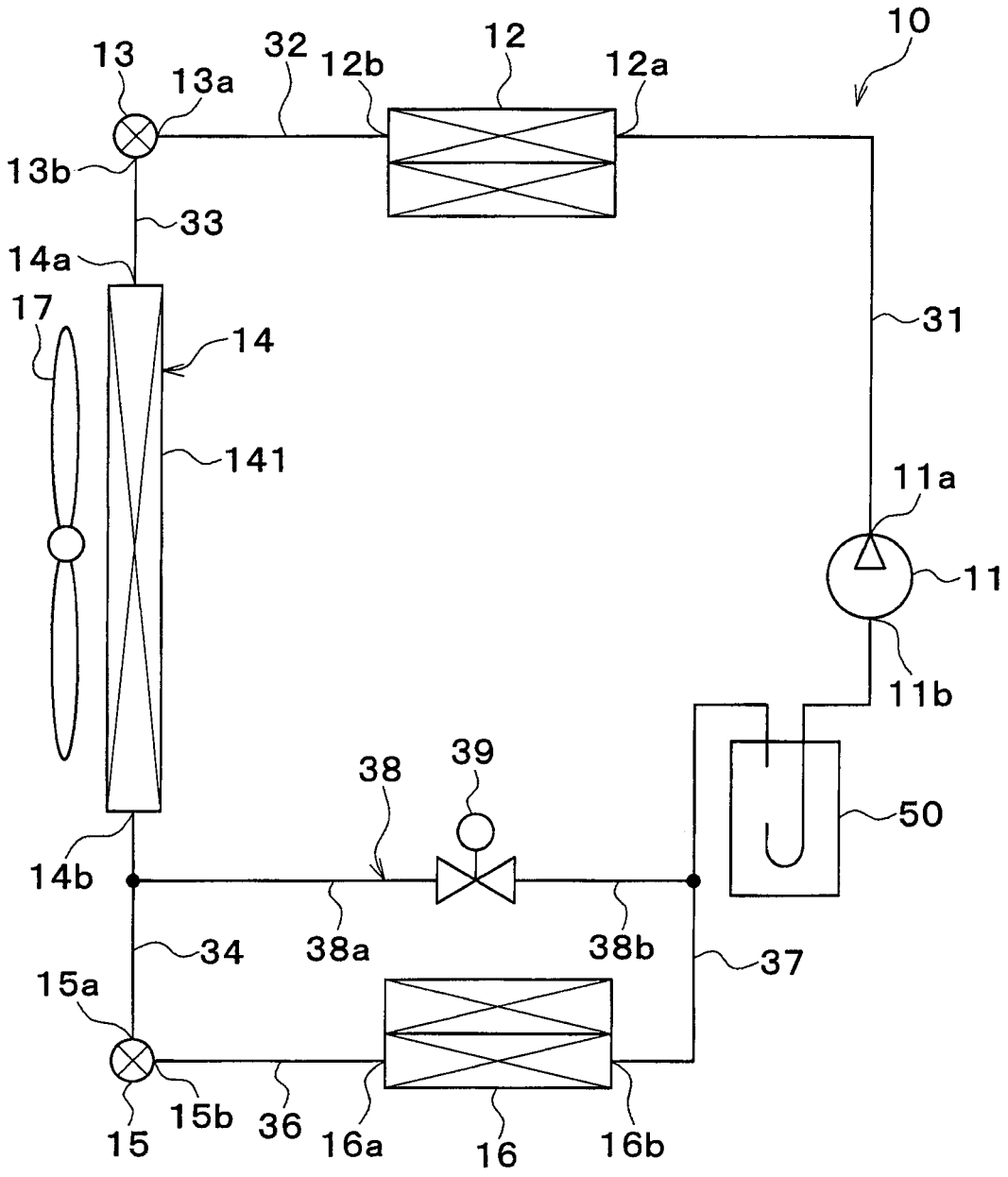
FIG. 35 is a diagram schematically illustrating an overall configuration of a refrigeration cycle device of at least one embodiment.

In a thirteenth example shown in FIG. 35, the evaporator bypass pipe 38 and the evaporator bypass on-off valve 39 are added to the second example of the seventh embodiment. One end of the evaporator bypass pipe 38 is connected to the outside heat exchanger outlet pipe 34. The other end of the evaporator bypass pipe 38 is connected to a part of the evaporator outlet pipe 37 between the accumulator 50 and the refrigerant outlet 16*b* of the evaporator 16.

In the second to twelfth example of the present embodiment, since the volume capacity of the condenser outlet portion is larger than the total volume capacity of the outside heat exchanger outlet portion and the bypass pipe inlet portion 38*a* as in the first example of the present embodiment, the same effects as the first example of the present embodiment can be achieved.

The above-described embodiments can be appropriately combined with each other. The above-described embodiments can be variously modified as follows, for example.

In the above described embodiments, the subcooling bypass on-off valve 18 may not be provided in the subcooling portion bypass pipe 35 or the subcooling bypass portion 144.

Although coolant is used as heat medium for adjusting the temperature of the temperature adjusting target devices in the above described embodiments, various medium such as oil may be used as heat medium.

The heat medium may be nanofluid. A nanofluid is a fluid in which nanoparticles having a particle diameter in the order of nanometers are mixed. When nanoparticles are mixed into the heat medium, the following effects can be obtained in addition to an effect of reducing a freezing point of the cooling water containing ethylene glycol to be anti-freezing liquid.

That is, the heat conductivity in a specified temperature range can be improved, the heat capacity of the heat medium can be increased, the anticorrosive effect of the metal pipe and the deterioration of the rubber pipe can be improved, and the flowability of the heat medium in extremely low temperature environment can be improved.

Such effects may vary according to a particle structure, a particle shape, a ratio of combination, and an additional material in the nanoparticles.

As such, the thermal conductivity can be improved. Therefore, a similar cooling efficiency can be obtained with a smaller amount of heat medium than the cooling water containing ethylene glycol.

Further, since the heat capacity of the heat medium can be increased, the amount of cold heat stored in the heat medium itself by using sensible heat can be increased.

By increasing the amount of the stored cold heat, it is possible to perform a temperature regulation in cooling or heating of a device using the stored cold heat for a certain time even when the compressor 11 is not in operation. As such, power saving in the thermal management device for a vehicle can be achieved.

The aspect ratio of the nanoparticles may be 50 or more preferably to obtain a sufficient thermal conductivity. The aspect ratio is a shape index that indicates the ratio between vertical and horizontal sizes of the nanoparticle.

The nanoparticle may contain at least one of Au, Ag, Cu, or C. Specifically, as a constituent atom of the nanoparticle, an Au nanoparticle, an Ag nanowire, CNT, graphene, a graphite core shell nanoparticle, or an Au nanoparticle-containing CNT may be used.

CNT is carbon nanotubes. A graphite core shell nanoparticle is a particle body including a structure such as carbon nanotube surrounding the atom.

In the refrigeration cycle device 10 of the above-described embodiments, a fluorocarbon refrigerant is used as the refrigerant. However, the refrigerant may not be limited to being the fluorocarbon refrigerant. Various refrigerant may be used.

Although the present disclosure has been described in accordance with the embodiments, it is understood that the present disclosure is not limited to the embodiments and structures disclosed therein. To the contrary, the present disclosure is intended to cover various modification and equivalent arrangements. In addition, while the various elements are shown in various combinations and configurations, which are exemplary, other combinations and configurations, including more, less or only a single element, are also within the spirit and scope of the present disclosure.

What is claimed is:

1. A refrigeration cycle device comprising:

a compressor configured to draw a refrigerant and to discharge the refrigerant after compressing the refrigerant;

a condenser configured to condense the refrigerant discharged from the compressor by heat exchange;

a first decompressor configured to decompress and expand the refrigerant flowing out of the condenser;

an outside heat exchanger configured to exchange heat between outside air and the refrigerant flowing out of the first decompressor;

a second decompressor configured to decompress and expand the refrigerant flowing out of the outside heat exchanger;

an evaporator configured to evaporate the refrigerant flowing out of the second decompressor by heat exchange;

a condenser outlet pipe through which the refrigerant flowing out of the condenser flows into the first decompressor;

an outside heat exchanger inlet pipe through which the refrigerant flowing out of the first decompressor flows into the outside heat exchanger; and an outside heat exchanger outlet pipe through which the refrigerant flowing out of the outside heat exchanger flows into the second decompressor, wherein a predetermined part of a refrigerant passage from the condenser to the first decompressor through which the refrigerant flows is a condenser outlet portion, a predetermined part of a refrigerant passage from the first decompressor to the outside heat exchanger through which the refrigerant flows is an outside heat exchanger inlet portion, a predetermined part of a refrigerant passage from the outside heat exchanger to the second decompressor through which the refrigerant flows is an outside heat exchanger outlet portion, a volume capacity of the condenser outlet portion is larger than a volume capacity of the outside heat exchanger inlet portion, the condenser outlet portion is the condenser outlet pipe, the outside heat exchanger inlet portion is the outside heat exchanger inlet pipe, the outside heat exchanger outlet portion is the outside heat exchanger outlet pipe, the outside heat exchanger includes a heat exchange portion configured to exchange heat of the refrigerant, an outside heat exchanger liquid reservoir configured to separate the refrigerant exchanging heat in the heat exchange portion into a gas refrigerant and a liquid refrigerant and to store an excess amount of the refrigerant, and an outside heat exchanger subcooling portion configured to subcool the liquid refrigerant flowing out of the outside heat exchanger liquid reservoir, and the outside heat exchanger outlet pipe includes a subcooling portion outlet pipe through which the liquid refrigerant subcooled in the outside heat exchanger subcooling portion flows into the second decompressor, and a subcooling portion bypass pipe through which the refrigerant flowing out of the outside heat exchanger liquid reservoir bypasses the outside heat exchanger subcooling portion and flows into the second decompressor.

2. A refrigeration cycle device comprising:

a compressor configured to draw a refrigerant and to discharge the refrigerant after compressing the refrigerant;

a condenser configured to condense the refrigerant discharged from the compressor by heat exchange;

a first decompressor configured to decompress and expand the refrigerant flowing out of the condenser;

an outside heat exchanger configured to exchange heat between outside air and the refrigerant flowing out of the first decompressor;

a second decompressor configured to decompress and expand the refrigerant flowing out of the outside heat exchanger;

an evaporator configured to evaporate the refrigerant flowing out of the second decompressor by heat exchange;

a condenser outlet pipe through which the refrigerant flowing out of the condenser flows into the first decompressor; and an outside heat exchanger outlet pipe through which the refrigerant flowing out of the outside heat exchanger flows into the second decompressor, wherein a predetermined part of a refrigerant passage from the condenser to the first decompressor through which the refrigerant flows is a condenser outlet portion, a predetermined part of a refrigerant passage from the outside heat exchanger to the second decompressor through which the refrigerant flows is an outside heat exchanger outlet portion, a volume capacity of the condenser outlet portion is larger than a volume capacity of the outside heat exchanger outlet portion, the condenser outlet portion is the condenser outlet pipe, the outside heat exchanger outlet portion is the outside heat exchanger outlet pipe, the outside heat exchanger includes a heat exchange portion configured to exchange heat of the refrigerant, an outside heat exchanger liquid reservoir configured to separate the refrigerant exchanging heat in the heat exchange portion into a gas refrigerant and a liquid refrigerant and to store an excess amount of the refrigerant, and an outside heat exchanger subcooling portion configured to subcool the liquid refrigerant flowing out of the outside heat exchanger liquid reservoir, and the outside heat exchanger outlet pipe includes a subcooling portion outlet pipe through which the liquid refrigerant subcooled in the outside heat exchanger subcooling portion flows into the second decompressor, and a subcooling portion bypass pipe through which the refrigerant flowing out of the outside heat exchanger liquid reservoir bypasses the outside heat exchanger subcooling portion and flows into the second decompressor.

3. A refrigeration cycle device comprising:

a compressor configured to draw a refrigerant and to discharge the refrigerant after compressing the refrigerant;

a condenser configured to condense the refrigerant discharged from the compressor by heat exchange;

a first decompressor configured to decompress and expand the refrigerant flowing out of the condenser;

an outside heat exchanger configured to exchange heat between outside air and the refrigerant flowing out of the first decompressor;

a second decompressor configured to decompress and expand the refrigerant flowing out of the outside heat exchanger;

an evaporator configured to evaporate the refrigerant flowing out of the second decompressor by heat exchange; and a condenser outlet pipe through which the refrigerant flowing out of the condenser flows into the first decompressor, wherein a predetermined part of a refrigerant passage from the condenser to the first decompressor through which the refrigerant flows is a condenser outlet portion, a predetermined part of a refrigerant passage from the outside heat exchanger to the second decompressor through which the refrigerant flows is an outside heat exchanger outlet portion, a volume capacity of the condenser outlet portion is larger than a volume capacity of the outside heat exchanger outlet portion, the condenser outlet portion is the condenser outlet pipe, the second decompressor includes a second valve body configured to adjust a decompression of the refrigerant, a second valve seat onto which the second valve body is seated, a second decompressor inlet portion located upstream of the second valve seat with respect to a flow of the refrigerant, and a second decompressor outlet portion located downstream of the second valve seat with respect to the flow of the refrigerant, the outside heat exchanger includes a heat exchange portion configured to exchange heat of the refrigerant, an outside heat exchanger liquid reservoir configured to separate the refrigerant exchanging heat in the heat exchange portion into a gas refrigerant and a liquid refrigerant and to store an excess amount of the refrigerant, and an outside heat exchanger subcooling portion configured to subcool the liquid refrigerant flowing out of the outside heat exchanger liquid reservoir, the refrigeration cycle device further comprises:

a subcooling portion outlet pipe through which the liquid refrigerant subcooled in the outside heat exchanger subcooling portion flows into the second decompressor; and a subcooling portion bypass pipe through which the refrigerant flowing out of the outside heat exchanger liquid reservoir bypasses the outside heat exchanger subcooling portion and flows into the second decompressor, wherein the outside heat exchanger outlet portion is the subcooling portion outlet pipe, the subcooling portion bypass pipe, and the second decompressor inlet portion.

* * * * *